US011970323B2

(12) United States Patent
Sutto et al.

(10) Patent No.: US 11,970,323 B2
(45) Date of Patent: Apr. 30, 2024

(54) PACKAGE AND PROCESS FOR MAKING SAID PACKAGE

(71) Applicant: Cryovac, LLC, Charlotte, NC (US)

(72) Inventors: Luca Sutto, Casale Litta (IT); Stefano Capitani, Como (IT)

(73) Assignee: Cryovac, LLC, Charlotte, NC (US)

( * ) Notice: Subject to any disclaimer, the term of this patent is extended or adjusted under 35 U.S.C. 154(b) by 0 days.

(21) Appl. No.: 17/910,861

(22) PCT Filed: Mar. 12, 2021

(86) PCT No.: PCT/EP2021/056408

§ 371 (c)(1),
(2) Date: Sep. 12, 2022

(87) PCT Pub. No.: WO2021/180961

PCT Pub. Date: Sep. 16, 2021

(65) Prior Publication Data

US 2023/0105267 A1 Apr. 6, 2023

(30) Foreign Application Priority Data

Mar. 13, 2020 (EP) ..... 20163080

(51) Int. Cl.
*B65D 77/20* (2006.01)

(52) U.S. Cl.
CPC ..... *B65D 77/204* (2013.01); *B65D 2577/205* (2013.01); *B65D 2577/2066* (2013.01)

(58) Field of Classification Search
CPC ..... B65D 2577/2083; B65D 77/204; B65D 2577/2041; B65D 2577/205; B65D 77/20; B65D 77/2036
USPC ..... 220/270
See application file for complete search history.

(56) References Cited

U.S. PATENT DOCUMENTS

| | | | | |
|---|---|---|---|---|
| 3,083,821 | A * | 4/1963 | Woodson | B65D 81/3294 229/123.1 |
| 5,916,613 | A | 6/1999 | Stockley, III | |
| 7,803,416 | B2 | 9/2010 | Roveda et al. | |
| 11,279,543 | B2 * | 3/2022 | Capitani | B65B 61/18 |
| 2007/0272688 | A1 | 11/2007 | Longo et al. | |
| 2018/0370713 | A1 | 12/2018 | Kado et al. | |
| 2020/0331684 | A1 * | 10/2020 | Ghirardi | B65B 7/2878 |

FOREIGN PATENT DOCUMENTS

| | | | |
|---|---|---|---|
| FR | 3002209 | A1 | 8/2014 |
| WO | 2019123382 | A1 | 6/2019 |

* cited by examiner

*Primary Examiner* — Anthony D Stashick
*Assistant Examiner* — Raven Collins
(74) *Attorney, Agent, or Firm* — Jon M. Isaacson

(57) ABSTRACT

A package includes a support having a base having a product thereon, a peripheral flange surrounding the base and forming at least one gripping tab, and a film engaged with the peripheral flange to define a housing compartment for the product. The support has a first surface and a second surface, with the second surface presenting heat bonding properties to the film that are different from heat bonding properties of the first surface to the film. The gripping tab includes a first portion and a second portion arranged above the first portion. The gripping tab is externally defined by the second surface and includes a peripheral edge which is part of a radially external perimeter of the peripheral flange.

17 Claims, 9 Drawing Sheets

PACKAGE AND PROCESS FOR MAKING SAID PACKAGE

FIELD OF THE INVENTION

The present invention relates to a package, in particular for containing products, for example of a food type. The invention also relates to a process and a relative apparatus for manufacturing this package using a support or tray designed to house at least one product, and a plastic film mating with the support or tray in order to seal the product into the package. The invention may have application in vacuum packaging or in controlled atmosphere packaging of products of various type.

PRIOR ART

In the food packaging field, packages closed by means of plastic films and provided with a facilitated opening system are known: the facilitated opening system aims to ensure a simple opening and rapid extraction of the product from the package by a user.

A first example of a facilitated opening package, described in the French patent application FR 3002209 A1, provides a tray having a substantially rectangular shape and a plastic film welded to a peripheral edge of the tray. The tray and the film comprise respective gripping portions. A first part of the film gripping portion can be lifted relative to the underlying tray gripping portion, while a second part of the film gripping portion is attached to a stiffening tab separable from the tray: the second part of the film gripping portion together with the stiffening tab form an opening portion which can be grasped by the user for opening the package, while the gripping portion of the tray, on the other hand, is the part which can be grasped by the user for holding the support while removing the film from the package. Applicant has noted that the opening system of French patent application FR 3002209 A1 presents a number of drawbacks: in particular, this system requires a relatively big amount of material for making the package and substantial changes to conventional tray forming and packaging processes to provide, at the same time, sealing of the package, adhesion between the second part of the film gripping portion and the stiffening tab of the tray, and separation between the first part of the film gripping portion and the gripping portion of the tray. In other words, the complex design of the opening system negatively impacts in terms of production costs, complexity of the manufacturing process and overall size of the package. Document WO2019123382 is directed to a package comprising a support having a base configured for receiving one or more products, a peripheral edge surrounding the base, and a removable portion extending as a prolongation of the peripheral edge away from the base. The package further comprises a closing film engaged with a portion of the peripheral edge and with the removable portion for defining a housing compartment for the product, and a gripping portion emerging from the peripheral edge: the removable portion is configured for being separated from the support, together with the film, during opening of the package. When the package is in a closed condition, the closing film is joined to the support to prevent access to the housing compartment and the removable portion is aligned with the peripheral edge from which it extends as a prolongation. The removable portion also has a cavity which presents a concavity, at least in the closed condition of the package, facing the peripheral edge. The gripping portion is disposed, at least in the closed condition of the package, within this cavity. Although this solution represents a significant improvement over the above French reference, the Applicant found further ways to simplify the overall package thereby offering an easy to manufacture package provided with facilitated opening properties.

OBJECT OF THE INVENTION

The object of the present invention is to solve the drawbacks and/or limitations of the above prior art.

A first object of the invention is to provide a package having an effective facilitated opening system to allow the user a simple and quick opening of the package; in particular, it is an object of the present invention to provide a package that provides the user with a rapid tactile or visual perception of the facilitated opening system.

A further object of the present invention is to provide a package having a simple and cost-effective structure which at the same time can ensure a convenient and stable handling of the package during the opening of the latter.

A further object is to provide a package that can be manufactured by means of a simple and fast in-line production, which does not require expensive modifications to the manufacturing plants of standard packages, i.e. those used for making packages without a facilitated opening system.

A further object is to provide a package designed to speed up manufacturing operations and to reduce manufacturing costs.

These and yet other objects, which will become more apparent from the following description, are substantially achieved by a package, an apparatus and a related process for manufacturing the package according to one or more of the accompanying claims and/or the following aspects.

SUMMARY

In a 1$^{st}$ aspect, a package (100) is provided containing at least one product (P), the package comprising:

at least one support (1) comprising:

at least one base (2) receiving the at least one product (P), a peripheral flange (6) surrounding the base (2) and forming at least one gripping tab (22), wherein the support (1) is formed from a substrate having a first surface (1*a*) and a second surface (1*b*), opposite to the first surface (1*a*); and a closing film (10) engaged with at least part of the peripheral flange (6) and defining with the support (1) a housing compartment (5) for the product (P), the closing film (10) being configured to be at least partially separated from the support (1) during a step of opening the package (100) to allow access to the housing compartment (5).

In a 2$^{nd}$ according to the first aspect the substrate is a continuous plastic substrate, for example a continuous plastic foil or a continuous plastic web, which may then be appropriately cut and shaped to form the support (1).

In a 3$^{rd}$ aspect according to any one of the preceding aspects the gripping tab (22) comprises at least a first portion (22*a*) and a second portion (22*b*) placed in overlapping position above the first portion (22*a*).

In a 4$^{th}$ aspect according to any one of the preceding 1$^{st}$ and second aspect the gripping tab (22) comprises at least a first portion (22*a*) and a second portion (22*b*) placed in overlapping position above the first portion (22*a*), whereby a part of the first surface (1*a*) carried by the first portion (22*a*) faces a corresponding part of the first surface (1*a*)

carried by the second portion (22*b*), and whereby a part of the second surface (1*b*) carried by the first portion (22*a*) and a part of the second surface (1*b*) carried by the second portion (22*b*) form opposite external sides of the gripping tab (22).

In a 5$^{th}$ aspect according to any one of the preceding aspects the gripping tab (22) has a peripheral edge (22*d*) which is part of a radially external perimeter (3) of the peripheral flange (6).

In a 6$^{th}$ aspect according to any one of the preceding aspects the second surface (1*b*) presents heat bonding properties to the closing film (10) different from the heat bonding properties of the first surface (1*a*) to the same closing film and the second portion is connected, optionally heat bonded, to the first portion (22*a*).

In a 7$^{th}$ aspect according to any one of the preceding aspects the peripheral edge (22*d*) of the gripping tab (22) is formed by overlapping peripheral edges of the first portion (22*a*) and of the second portion (22*b*).

In a 8$^{th}$ aspect according to any one of the preceding aspects the package is configured such that, in a package closed condition, the closing film (10) is gas tightly engaged with, in particular heat bonded, at least to an annular bonding area (6*a*) of the peripheral flange (6) for gas tightly sealing the housing compartment (5) from an outer environment external to the housing compartment.

In a 9$^{th}$ aspect according to any one of the preceding aspects the closing film (10) is also heat bonded to the first surface (1*a*) of the support not occupied by the product (P).

In a 10$^{th}$ aspect according to any one of the preceding two aspects the annular bonding area (6*a*) peripherally and entirely surrounds the housing compartment (5), the annular bonding area (6*a*) being part of the first surface (1*a*).

In a 11$^{th}$ aspect according to any one of the aspects from the 3$^{rd}$ to the preceding aspect the second portion (22*b*) is connected to the first portion (22*a*) at a folding line (22*c*).

In a 12$^{th}$ aspect according to the preceding aspect, the second portion (22*b*) is folded above the first portion (22*a*) around said folding line (22*c*).

In a 13$^{th}$ aspect according to any one of the preceding two aspects the peripheral edge (22*d*) of the gripping tab (22) and of the perimeter (3) comprises a side, optionally a rectilinear side (22*e*'), extending along the folding line (22*c*).

In a 14$^{th}$ aspect according to any one of the preceding three aspects said folding line (22*c*) extends from the radially outermost part of the peripheral edge (22*d*) of the gripping tab (22) to the annular bonding area (6*a*).

In a 15$^{th}$ aspect according to any one of the preceding aspects the first surface (1*a*) of the support (1) is configured to heat seal to the closing film (10) at a heat bonding temperature comprised between 140° C. and 240° C., while the second surface (1*b*) of the support (1) is configured to not heat seal to the closing film at said heat bonding temperature.

In a 16$^{th}$ aspect according to any one of the preceding aspects from the 1$^{st}$ to the 14$^{th}$ the first surface (1*a*) of the support (1) is configured to heat seal to the closing film (10) at a heat bonding temperature comprised between 140° C. and 240° C. providing a first welding force, while the second surface (1*b*) of the support (1) is configured to heat seal to the closing film at said heat bonding temperature providing a second welding force weaker than the first welding force, in particular 50% or more weaker than the first welding force.

In a 17$^{th}$ aspect according to any one of the preceding two aspects the continuous substrate comprises a multilayer structure having at least one top layer film made from a material that heat seals to the closing film (10) at said heat bonding temperature and at least one bottom layer film made from a material that does not heat seal (or heat seals with less welding force that the top layer film) to the closing film (10) at said heat bonding temperature.

In an 18$^{th}$ aspect according to any one of the preceding aspects the support (1) presents a substantially rectangular, squared or triangular shape.

In a 19$^{th}$ aspect according to any one of the preceding aspects the gripping tab (22) is arranged at a corner region of the support (1).

In a 20$^{th}$ aspect according to the preceding aspect the folding line (22*c*) extends up to a, optionally rounded or blunt or pointed, tip of said corner region of the support (1).

In a 21$^{st}$ aspect according to any one of the preceding aspects the gripping tab (22) is an integral part of the peripheral flange (6) of the support (1).

In a 22$^{nd}$ aspect according to any one of the preceding aspects the package is configured such that, in a/the package closed condition, the closing film (10) is not bonded, in particular not heat bonded, to the external side of the gripping tab (22) and forms a flap (10*c*) configured to be grabbed by a user to bring the package from said package closed condition to an at least partially open condition where the closing film (10) is at least partially separated from the support (1) to allow access to the housing compartment (5).

In a 23$^{rd}$ aspect according to the preceding aspect, in the package closed condition, the flap (10*c*) extends above the gripping tab (22) and radially outside an/said annular bonding area (6*a*) of the film with the peripheral flange (6), wherein a portion of said annular bonding area (6*a*) is radially interposed between the flap (10*c*) and the housing compartment (5).

In a 24$^{th}$ aspect according to any one of the preceding two aspects the flap (10*c*) has a portion, not covering gripping tab (22) and not covering flange (6), extending above an indent (20) in the perimeter (3) of the peripheral flange (6) and directly operable by a user.

In a 25$^{th}$ aspect according to any one of the preceding three aspects the closing film (10) and the flap (10*c*) extend beyond the peripheral edge of the gripping tab (22) and beyond the perimeter (3) of the peripheral flange (6) only in correspondence of said indent (20).

In a 26$^{th}$ aspect according to any one of the preceding four aspects, in the closed condition of the package (100), the flap (10*c*) covers at least a major portion of the gripping tab (22) top surface, for example at least 60% or at least 70% or at least 80% of the top surface of the gripping tab. In a variant, in the closed condition of the package (100), the flap (10*c*) covers the entirety of the gripping tab (22) top surface.

In a 27$^{th}$ aspect according to any one of the preceding there aspects, in the closed condition of the package (100), the flap (10*c*) covers at least a major portion of the indent (20), for example at least 60% or at least 70% or at least 80% or the total of the indent (20).

In a 28$^{th}$ aspect according to any one of the preceding six aspects, the external side, and in particular the top surface, of the gripping tab (22) is not bonded to and directly faces a bottom surface of the flap (10*c*) of the closing film (10).

In a 29$^{th}$ aspect according to any one of the preceding seven aspects, the closing film (10) and the gripping tab (22) extend parallel to each other, in particular wherein the flap (10*c*) of the closing film (10) and the gripping tab (22) extend parallel to each other.

In a 30$^{th}$ aspect according to any one of the preceding aspects, the first surface (1*a*) of the support (1) defines inner sides of the first and second portions (22*a*, 22*b*) of the gripping tab (22), the inner side of the first portion (22*a*) directly facing the inner side of the second portion (22*b*) of the gripping tab (22).

In a 31$^{st}$ aspect according to any one of the preceding aspects the/a inner side of the first portion (22*a*) of the gripping tab (22) is bonded, in particular heat-bonded, to the/a inner side of the second portion (22*b*) of the gripping tab (22).

In a 32$^{nd}$ aspect according to one of the preceding to aspects the inner side of the first portion (22*a*) of the gripping tab (22) is coplanar to the peripheral flange (6) of the support (1).

In a 33$^{rd}$ aspect according to any one of aspects from the 11$^{th}$ to the preceding aspect the folding line (22*c*) of the gripping tab (22) defines a tract of the external perimeter (3) of the peripheral flange, a major portion of the extension said folding line (22*c*), in particular at least 60% or at least 70% or at least 80% ort at least 90% of the extension of the folding line, being covered by the flap (10*c*) of the closing film (10) when the package is in the package closed condition.

In a 34$^{th}$ aspect according to any one of aspects from the 11$^{th}$ to the preceding aspect the folding line (22*c*) of the gripping tab (22) defines a tract of the external perimeter (3) of the peripheral flange, the entirety of the extension said folding line, being covered by the flap (10*c*) of the closing film (10) when the package is in the package closed condition.

In a 35$^{th}$ aspect according to any one of aspects from the 11$^{th}$ to the preceding aspect the folding line (22*c*) of the gripping tab (22) extends transversally to an immediately consecutive portion of the external perimeter (3) of the flange (6) of the support (1).

In a 36$^{th}$ aspect according to any one of aspects from the 11$^{th}$ to the preceding aspect the folding line (22*c*) of the gripping tab (22) extends along a direction transversal to the housing compartment (5) of the package (100).

In a 37$^{th}$ aspect according to one of the preceding to aspects the first and the second portions (22*a*, 22*b*) of the gripping tab (22) are identical overlapping portions in intimate contact the one with the other.

In a 38$^{th}$ aspect according to any one of aspects from the 11$^{th}$ to the preceding aspect the folding line (22*c*) extends rectilinearly between a first and a second end, the first end being closer to the housing compartment (5) with respect to the second end.

In a 39$^{th}$ aspect according to the preceding aspect the flap (10*c*) of the closing film (10) extends up to and beyond the first end of the folding line (22*c*), in particular the flap (10*c*) covering the first end of the folding line (22*c*).

In a 40$^{th}$ aspect according to any one of the preceding two aspects the flap (10*c*) of the closing film (10) extends up to and beyond the second end of the folding line (22*c*).

In a 41$^{st}$ aspect according to any one of the preceding three aspects the gripping tab presents a substantially triangular shape, in particular a square triangle shape with square angle arranged at the first end of the folding line (22*c*).

In a 42$^{nd}$ aspect according to any one of the preceding aspects the second portion (22*b*) of the gripping tab is obtained by:

forming a separation line (9), in particular a cutting line, on the peripheral flange (6), and folding said second portion (22*b*) around the folding line (22*c*) onto the first portion (22*a*), said separation line (9) being transversal, in particular perpendicular, to said folding line (22*c*).

In a 43$^{rd}$ aspect according to the preceding aspect the second portion (22*b*) of the gripping tab (22) is delimited by a separation edge (9*a*) formed by said separation line (9), by the folding line (22*c*) and by a portion of the external perimeter (3) of the peripheral flange (6).

In a 44$^{th}$ aspect according to any one of the preceding two aspects a cutout portion, adjacent to the gripping tab (22) and having the shape of the second portion (22*b*), is formed on the peripheral flange (6), the cutout portion defining an indent (20) in the external perimeter (3) of the peripheral flange (6).

In a 45$^{th}$ aspect according to the preceding aspect a majority or the entirety of said cutout portion extends, with the package in closed condition, under the flap (10*c*).

In a 46$^{th}$ aspect according to any one of the preceding three aspects the separation edge (9*a*) of the second portion (22*b*) is transverse, in particular orthogonal, to the folding line (22*c*).

In a 47$^{th}$ aspect according to any one of the preceding four aspects the separation edge (9*a*) of the second portion (22*b*) is consecutive to the folding line (22*c*).

In a 48$^{th}$ aspect according to any one of the preceding aspects the second end of the folding line (22*c*) forms an acute angle with the external perimeter of the peripheral flange (6).

In a 49$^{th}$ aspect according to any one of the preceding aspects the/a flap (10*c*) of the closing film (10) is an integral part of the closing film and is made in the same plastic material of the rest of the closing film (10) and wherein the closing film (10) is entirely made of a plastic material.

In a 50$^{th}$ aspect according to any one of the preceding aspects the/a flap (10*c*) of the closing film (10) presents a substantially triangular shape.

In a 51$^{st}$ aspect according to any one of aspects from the 44$^{th}$ to the preceding aspect the closing film (10) covers the peripheral flange (6) at least in correspondence of said annular bonding area (6*a*) and has a closing film perimeter counter shaped to the external perimeter (3) of the peripheral flange (6) with the exception of a part of the perimeter of the peripheral flange at said cutout portion, and wherein in correspondence of said cutout portion the peripheral flange perimeter forms said/an indent (20) while the closing film does not form any indent and extends above the cutout portion.

In a 52$^{nd}$ aspect according to any one of the preceding aspects the second surface (1*b*) of the continuous substrate defining the support (1) comprises a coating layer of a not heat-sealable material configured for preventing or rendering weak the bond of the gripping tab (22) with the closing film (10).

In a 53$^{rd}$ aspect according to the preceding aspect the coating layer is made of or comprises at least one of:

wax, optionally synthetic wax, petroleum-derived wax, mineral wax;

high melting point thermoplastic resins, optionally polyesters, polyamides or PP homopolymer or resins chemically incompatible with the sealing layer of the closing film thermosetting resins;

smooth or embossed paper;

ink or paint;

metals, optionally aluminum.

In a 54$^{th}$ aspect according to any one of the preceding aspects the package (100) is configured for defining a pre-opening condition wherein:

the closing film (10) and the support (1) prevent access to the housing compartment (5), optionally the closing film (10) is stably engaged with the peripheral flange (6) for defining a fluid-tight housing compartment (5) for the product (P), the/a flap (10*c*) of the closing film is at least partially raised, optionally angularly offset, from the gripping tab (22) so that such the gripping tab is easily operable by a user.

In a 55$^{th}$ aspect according to any one of the preceding aspects the base (2) of the support (1) comprises a bottom wall (8) and a lateral wall (7), said lateral wall (7) emerging from the bottom wall (8) and defining, in cooperation with said bottom wall (8), a containment seat adapted to receive the product (P).

In a 56$^{th}$ aspect according to the preceding aspect the peripheral flange (6) emerges from the lateral wall (7) according to a radial direction away from the containment seat, said peripheral flange (6) being distanced from the bottom wall (8).

In a 57$^{th}$ aspect according to any one of the preceding two aspects the gripping tab (22) as part of the peripheral flange (6) also extends radially away from the lateral wall (7).

A 58$^{th}$ aspect concerns a process of making a package (100) for containing at least one product (P) according to any one of the preceding aspects.

In a 59$^{th}$ aspect according to the preceding aspect said process comprises at least the following steps:

providing one or more of said supports (1), positioning at least one product (P) on said base (2) of each support (1), constraining the closing film (10) to the peripheral flange (6) of each support (1) forming the respective housing compartment (5), the product (P) being positioned within the housing compartment (5).

In a 60$^{th}$ aspect according to the preceding aspect providing said one or more supports comprises providing said substrate having the first and second opposite surfaces (1*a*, 1*b*), and forming one or more supports (1) using said substrate.

In a 61$^{st}$ aspect according to any one of the preceding two aspects the process comprises forming the gripping tab (22) by bringing said second portion (22*b*) in overlapping position above the first portion (22*a*).

In a 62$^{nd}$ aspect according to the preceding aspect the step of forming the gripping tab (22) by bringing said second portion (22*b*) in overlapping position above the first portion (22*a*) comprises folding the second portion (22*b*) around the folding line (22*c*).

In a 63$^{rd}$ aspect according to any one of the preceding two aspects, the step of forming the gripping tab (22) comprises a step of defining the/a separation line (9) and the/a separation edge (9*a*).

In a 64$^{th}$ aspect according to the preceding aspect the step of forming the gripping tab (22) comprises said step of defining the separation line (9) and the separation edge (9*a*) by forming at least one notch on the support (1) or on the substrate used to form the support (1).

In a 65$^{th}$ aspect according to any one of the preceding two aspects the process provides for bringing said second portion (22*b*) in overlapping position above the first portion (22*a*) follows said step of defining the separation line (9).

In a 66$^{th}$ aspect according to any one of the preceding aspects from the 59$^{th}$ to the preceding aspect, the process comprises a step of coupling the first portion (22*a*) of the gripping tab (22) with the second portion (22*b*) of the gripping tab (22).

In a 67$^{th}$ aspect according to the preceding aspect said step of coupling comprises bonding the first portion (22*a*) with the second portion (22*b*).

In a 68$^{th}$ aspect according to the preceding aspect said step of coupling comprises heat bonding the inner side of the first portion (22*a*) with the inner side of the second portion (22*b*).

In a 69$^{th}$ aspect according to any one of aspects from the 59$^{th}$ to the preceding aspect the step of constraining the closing film (10) to the support (1) comprises a step of fluid-tightly heat-sealing said closing film (10) to the annular bonding area (6*a*) of the support (1) to define a fluid tight housing compartment (5).

In a 70$^{th}$ aspect according to any one of aspects from the 59$^{th}$ to the preceding aspect the step of constraining the closing film (10) to the annular bonding area (6*a*) is subsequent to the step of forming the gripping tab (22).

In a 71$^{st}$ aspect according to any one of aspects from the 59$^{th}$ to the preceding aspect the process comprises a step of removing gas, in particular air, from the housing compartment (5) to define a vacuum skin package (100).

In a 72$^{nd}$ aspect according to the preceding aspect said step of removing gas is antecedent to the step of constraining the closing film (10) to the annular bonding area (6*a*).

In a 73$^{rd}$ aspect according to any one of aspects from the 59$^{th}$ to the preceding aspect the process comprises a step of injecting a gas, in particular an inert gas, into the housing compartment (5) to define a controlled atmosphere package (100).

In a 74$^{th}$ aspect according to the preceding aspect said step of infusing gas being in particular antecedent to the step of constraining the closing film (10) to the annular bonding area (6*a*).

In a 75$^{th}$ aspect according any one of aspects from the 59$^{th}$ to the preceding aspect the substrate is in the form of a continuous substrate or web and wherein the step of forming one or more supports using the substrate comprises moving the continuous substrate or web along a predetermined advancement path (A) and thermoforming the continuous substrate or web.

In a 76$^{th}$ aspect according to the preceding aspect the process comprises a step of performing a rectilinear notch on the continuous substrate or web, said rectilinear notch defining both the rectilinear peripheral edge (22*d*) of the gripping tab (22) and the consecutive rectilinear side of the external perimeter (3) of the peripheral flange (6).

A 77$^{th}$ aspect concerns a packaging apparatus provided with a control unit configured for commanding actuators and tools to execute the process of anyone of aspects from the 59$^{th}$ to the preceding aspect.

A 78$^{th}$ aspect concerns a package according to any one of the preceding aspects wherein, in a package closed condition, the closing film (10) forms a flap (10*c*) configured to be grabbed by a user to bring the package from said package closed condition to an at least partially open condition where the closing film (10) is at least partially separated from the support (1) to allow access to the housing compartment (5).

A 79$^{th}$ aspect concerns a package according to any one of the preceding aspects wherein, the flap (10*c*) configured to be grabbed by the user is an integral part of the closing film and is exclusively made from a portion of the closing film.

An 80$^{th}$ aspect concerns a package according to any one of the preceding aspects wherein the flap (10*c*) configured to be grabbed by the user does not include any part of the support.

An 81$^{st}$ aspect concerns a package according to any one of the preceding aspects wherein in the package closed condition with the flap (10*c*) parallel to the peripheral flange (6), the peripheral edge (22*d*) of the grabbing tab (22) is part of said radially external perimeter (3) of the peripheral flange (6).

An 82$^{nd}$ aspect concerns a package according to any one of the preceding aspects wherein the package (100) is configured for defining a pre-opening condition wherein:

a. the closing film (10) and the support (1) prevent access to the housing compartment (5), optionally the closing film (10) is stably engaged with the peripheral flange (6) for defining a fluid-tight housing compartment (5) for the product (P), b. the/a flap (10*c*) of the closing film is at least partially raised, optionally angularly offset, from the gripping tab (22) so that such the gripping tab is operable by a user.

An 83$^{rd}$ aspect concerns a package according to any one of the preceding aspects wherein with the package in a/the pre-opening condition and said flap raised, optionally angularly offset, from the gripping tab, the raised flap made is exclusively from a portion of closing film material (10).

An 84$^{th}$ aspect concerns a package according to preceding aspect wherein said raised flap does not carry any part or material of the support (1).

An 85$^{th}$ aspect concerns a package according to any one of the preceding aspects wherein the flap (10*c*) has a free portion, not covering gripping tab (22) and not covering the peripheral flange (6), extending above an indent (20) in the perimeter (3) of the peripheral flange (6) and directly operable by a user.

An 86$^{th}$ aspect concerns a package according to any one of the preceding aspects wherein the flap free portion has the same shape, and optionally the same size, of the gripping tab (22).

An 87$^{th}$ aspect concerns a package according to any one of the preceding aspects wherein the peripheral flange (6) comprises a cutout portion, adjacent to the gripping tab (22) and having the shape of the second portion (22*b*).

In an 88$^{th}$ aspect according to the preceding aspect the cutout portion defines an indent (20) in the external perimeter (3) of the peripheral flange (6) having the same shape, or the same shape and the same size, of the gripping tab (22).

An 89$^{th}$ aspect concerns a package according to any one of the preceding aspects wherein the peripheral flange (6) comprises a cutout portion, adjacent to the gripping tab (22) and having the shape of the second portion (22*b*), the cutout portion defining optionally said indent (20) in the external perimeter (3) of the peripheral flange (6) having the same shape, or the same shape and the same size, of the gripping tab (22).

A 90$^{th}$ aspect concerns a package according to any one of the preceding aspects wherein the external perimeter (3) of the peripheral flange (6), when seen from above the package, has a convex shape.

A 91$^{st}$ aspect concerns a package according to any one of the preceding aspects wherein the external perimeter (3) of the peripheral flange (6), when seen from above the package, has a convex shape, with the exception for said the part of the perimeter where said indent (10) is located.

A 92$^{nd}$ aspect concerns a package according to any one of the preceding aspects wherein when the package is opened and the closing film (10) is completely removed from the support (1), no parts of the support (1), in particular no parts of the peripheral flange (6), are removed from this latter as a consequence of the opening.

A 93$^{rd}$ aspect concerns a package according to any one of the preceding aspects wherein each of the external sides (namely the top and bottom sides) of the gripping tab (22) has a surface area which is at least 40%, in particular at least 50%, of the top surface area of the flap (10*c*).

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIG. 9 shows the support before a folding step of a manufacturing process of the support, while FIG. 10 shows the support during the folding step aimed at forming a gripping tab according to the invention;

CONVENTIONS

Figure 1:
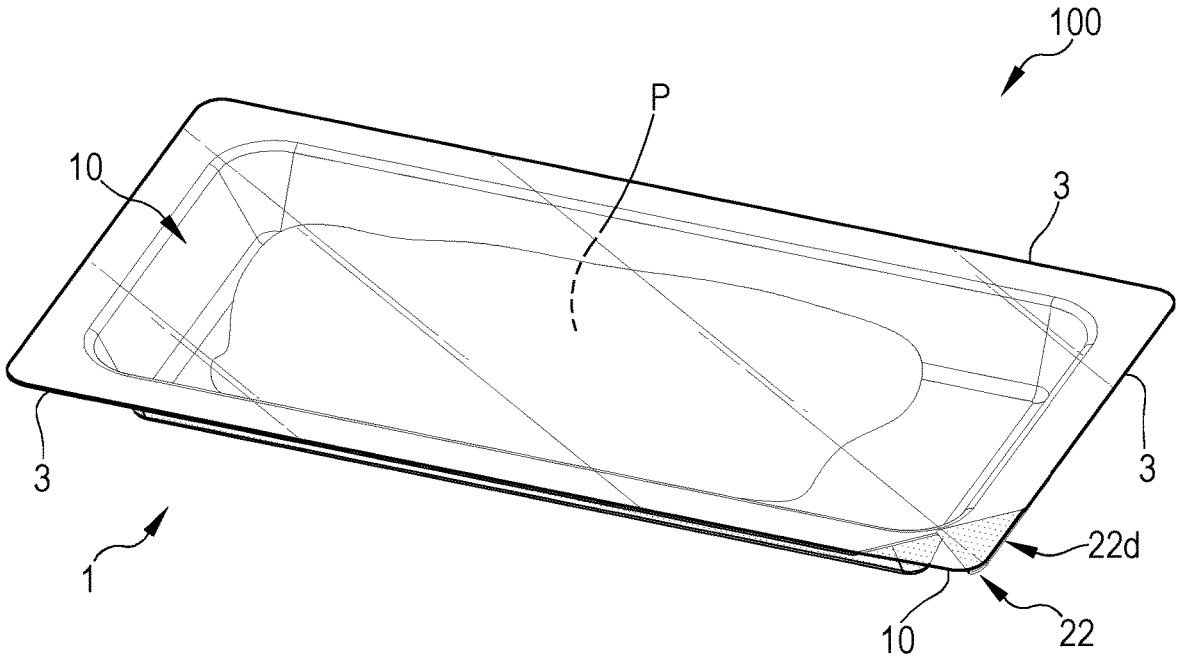
FIG. 1 is a perspective view of a package according to the present invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of a package—or of a support for making said package—along a predetermined path starting from a starting or forming station of a support for said package, through a packaging station and then up to a package unloading station.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described herein includes at least one control unit designed to perform the steps of the process for making the package. The control unit can clearly be only one or be formed by a plurality of different control units according to the design choices and the operational needs. The term control unit means an electronic component which can comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

Actuator

The term actuator means any device capable of causing movement on a body, for example on a command of the control unit (reception by the actuator of a command sent by the control unit). The actuator can be of an electric, pneumatic, mechanical (for example using a spring) type, or of another type.

Support 1

The support 1 may be a flat support having a peripheral band which may be regarded as a flange, or it may be in the form of a tray comprising at least one base and at least one lateral wall emerging from the outer perimeter of the base and a peripheral flange emerging radially outwardly from an upper peripheral edge of the lateral wall.

The support 1 has a top surface on which the product P can be placed and/or a volume inside which the product can be housed.

The support 1 when in the form of tray may comprise an upper edge portion emerging radially from a free edge of the lateral wall opposite the base: the upper edge portion emerges from the lateral wall in an outgoing direction relative to the tray volume.

In case of flat support, it can be of any shape, for example rectangular, rhomboidal, circular or elliptical; similarly, the support is a tray with lateral wall, it may have a base of any shape, for example rectangular, rhomboidal, circular or elliptical.

The support 1 may be formed by means of a specific manufacturing process distinct from the packaging process or it may be formed in line with the packaging process. The support 1 may be made at least partly of paper material, optionally having at least 50% by weight, preferably at least 70% by weight, of organic material comprising one or more of cellulose, hemicellulose, lignin, lignin derivatives. The subject paper material extends between a first and a second prevailing development surface. The paper foil used for making the support may, in one embodiment variant, be covered by at least a part of the first and/or second prevailing development surface by means of a plastic coating, such as a food-grade film. If the coating is arranged so as to cover at least part of the first prevailing development surface, the same coating will define an inner surface of the support. Vice versa, if the coating is arranged on the second prevailing development surface, the same coating will define an outer surface of the support. The coating may also be used to define a sort of barrier to water and/or humidity useful for preventing the weakening and loss of structural properties of the support with consequent uncontrolled deformation of the paper material constituting the latter component. The coating can be applied to the paper material (as specified above on the inside and/or outside of the support) in the form of a so-called lacquer deposited from a solution or sprayed, the thickness whereof is generally comprised between 0.2 μm and 10 μm. Alternatively, the coating may comprise a plastic film, for example a polyethylene, which can be applied by means of a rolling process, on one or both sides (inner and/or outer side) of the paper material defining the support. In case the coating is applied by rolling, the values of the plastic film (coating) may, for example, range from 10 μm to 400 μm, in particular, from 20 μm to 200 μm, even more in particular, from 30 μm to 80 μm, of coating material (i.e., polyethylene). The plastic coating material may be selected, by way of example, from the following materials: PP, PE (HDPE, LDPE, MDPE, LLDPE), EVA, polyesters (including PET and PETg), PVdC.

The support may be alternatively made at least in part of a mono-layer or multilayer thermoplastic material. The support may be provided with gas barrier properties. As used herein, this term refers to a film or sheet of material that has an oxygen transmission rate of less than 200 $cm^3/(m^2*day*bar)$, less than 150 $cm^3/(m^2*day*bar)$, less than 100 $cm^3/(m^2*day*bar)$ when measured in accordance with ASTM D-3985 at 23° C. and 0% relative humidity. Gas barrier materials suitable for single-layer thermoplastic containers are e.g. polyesters, polyamides, ethylene vinyl alcohol (EVOH), PVdC and the like.

The support may be made of a multilayer material comprising at least one layer of: one or more gas barrier layers, one or more heat-sealable layers (adapted to allow the sealing of the coating film to the support surface), one or more outer layers (for example polyamide or polypropylene or polyester).

The gas barrier polymers that can be used for the gas barrier layer are PVDC, EVOH, polyamides, polyesters and mixtures thereof. Generally, a PVDC barrier layer will contain plasticizers and/or stabilizers as known in the art. The thickness of the gas barrier layer will preferably be set in order to provide the material of which the support is composed with an oxygen transmission rate at 23° C. and 0% relative humidity of, less than 50 $cm^3/(m^2*day*atm)$, preferably less than 10 $cm^3/(m^2*day*atm)$, when measured in accordance with ASTM D-3985.

The heat-sealable layer will be selected from polyolefins, such as ethylene homo- or copolymers, propylene homo- or copolymers, ethylene/vinylacetate copolymers, ionomers and homo- or co-polyesters, e.g. PETG, a glycol-modified polyethylene terephthalate.

Additional layers, such as adhesive layers, for example to make the gas barrier layer better adhere to the adjacent layers, may preferably be present in the multilayer material of the support and are selected based on the specific resins used for the gas barrier layer.

In the case of a multilayer structure, part of it may be formed as a foam. For example, the multilayer material used for forming the support can comprise (from the outermost layer to the layer of contact with the more internal foods) one or more structural layers, typically made of a material such as expanded polystyrene, expanded polyester or expanded polypropylene, or of cardboard, or sheet for example polypropylene, polystyrene, poly(vinyl chloride), polyester; a gas barrier layer and a heat-sealable layer.

The overall thickness of the support may be up to 5 mm. For example, the thickness may be between 0.04 mm and 3.00 mm, optionally between 0.05 mm and 1.50 mm, even more optionally between 0.6 mm and 1.00 mm. In one embodiment, the support comprises an overall thickness of between 0.06 and 0.4 mm.

The support may be made entirely of paper material (optionally coated with a plastic film) or it may be entirely made of plastic material. Alternatively, the support may be at least partly made of paper material and at least partly of plastic material; in particular, the support is made internally of plastic material and externally covered at least partly in paper material.

The support can also be used to define so-called ready-meal packages; in this configuration, the supports are made so that they can be inserted in the oven or microwave oven for heating and/or cooking the food product placed in the package. In this embodiment (supports for ready-meal packages), the support can, for example, be made of paper material, in particular cardboard, covered with polyester or can be entirely made of a polyester resin. For example, supports suitable for ready-meal packages are made of PP, CPET, APET or APET/CPET, foamed or non-foamed materials. The support may further comprise a heat-sealable layer of a low melting material on the film. This hot-weldable layer can be co-extruded with a PET based layer or it can be deposited on the base film by solvent deposition or by extrusion coating.

In a further embodiment, the support may be made at least partly of metal material, in particular aluminum. The support can also be made at least partly of aluminum and/or at least partly of paper material. In general, the support may be made of at least one of the following materials: plastic, paper, metal.

Heat Bonding

In the course of the description (with reference with some of the possible embodiments) and in some claims it is indicated that certain surfaces of the support 1, in particular second surface 1*b* of the support 1 and the surface of gripping tab 22 destined to come in contact with the closing film 10, may not heat bondable to the closing film 10. This means that, at the temperature the closing film 10 needs to be brought to heat bond to the support first surface 1*a* (i.e., the temperature which is sufficient to heat bond the closing film 10 to the first surface 1*a* of the support), the mentioned second surface 1*b* of the support 1 and the mentioned surface of the gripping tab do not bond with the plastic film 10 (or very scarcely stick to the plastic film 10 to an extent that the same plastic film 10 is easily peelable from the support surface 1*b* or from the gripping tab with substantially no effort for a user).

This is obtained making the support from a continuous substrate, in particular from a plastic foil, having a first surface 1*a*, and a second surface 1*b*, opposite to the first surface 1*a*, with the second surface 1*b* presenting heat bonding properties to the closing film 10 different from the heat bonding properties of the first surface 1*a* to the same closing film at a temperature: in particular, at a temperature where the closing film 10 bonds, in particular sealingly bonds in a fluid tight manner, to the first surface 1*a*, the second surface 1*b* does not bond or is significantly less bonding to closing film then the first surface. For example, this may be obtained by making the support with at least one bottom layer (defining the second surface 1*b*) comprising not-heat-bondable, in particular not heat-sealable, material selected from:

- wax, for example synthetic wax, petroleum-derived wax, mineral wax;
- plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;
- smooth or embossed paper;
- ink,
- paint;
- metals, for example aluminum.

In practice, thanks to the described conformation of the support 1, the strength of heat bonding or weld of the closing film to the second surface 1*b* or to the surface of the gripping tab 22 is significantly smaller than the strength of heat bonding or weld of the closing film 10 to the first surface 1*a* in particular to the first surface at the flange 6. A method of measuring the strength of a weld, herein referred to as a "welding force" or "welding strength", is described in ASTM F-88-00. The welding force of the closing film 10 to the surface 1*a* may for example be above 100 g/25 mm, preferably above 200 g/25 mm, more preferably above 400 g/25 mm, and even more preferably above 600 g/25 mm, while the welding force of the closing film 10 to the second surface 1*b* or to the surface of the gripping tab 22 may be below 100 g/25 mm, preferably below 75 g/25 mm, even more preferably below 50 g/25 mm or even zero.

The Closing Film 10

The closing film 10 is made of plastic material, in particular polymeric material, and is applied to the supports (flat supports or trays), so as to create a fluid-tight package housing the product. In order to make a vacuum pack, the film 10 applied to the support 1 is for example a flexible single or multilayer material comprising at least a first outer heat-weldable layer capable of welding to the surface 1*a* of the support. In case of a multilayer closing film 10, the film may include an optional gas barrier layer and a second, heat-resistant, outer layer.

If it is desired to make a modified atmosphere package (MAP) or a package under natural atmosphere (non-modified atmosphere), the film applied to the support may be a film made of plastic, in particular polymeric material, and may typically be single-layer or multilayer. In the case of a multilayer film, it may comprise at least one of: one or more gas barrier layers, one or more heat-sealable layers (layers adapted to allow a plastic film to be welded to the support), one or more heat-resistant layers, one or more outer layers (for example polyamide or polypropylene or polyester).

For use in a skin-pack or VSP packaging process, plastic materials, especially polymers, for the closure film should be easily formable as the film needs to be stretched and softened by contact with a heating plate of the packaging apparatus before it is laid on the product and the support. The film must rest on the product conforming to the product shape and possibly to the internal shape of the support. The heat-sealable (for example outer) layer may comprise any polymer capable of welding to the inner surface of the support. Suitable polymers for the heat-sealable layer can be ethylene and ethylene copolymers, such as LDPE, ethylene/alpha-olefin copolymers, ethylene/acrylic acid copolymers, ethylene/vinyl acetate copolymers or ethylene/vinyl acetate copolymers, ionomers, co-polyesters, for example PETG.

Preferred materials for the heat-sealable layer are LDPE, ethylene/alpha-olefin copolymers, e.g. LLDPE, ionomers, ethylene/vinyl acetate copolymers and mixtures thereof.

Depending on the product to be packaged, the film may comprise a gas barrier layer. The gas barrier layer typically comprises oxygen-impermeable resins such as PVDC, EVOH, polyamides and mixtures of EVOH and polyamides. Typically, the thickness of the gas barrier layer is set to provide the film with an oxygen transmission rate of 23° C. and 0% relative humidity of, less than 100 $cm^3/m^2*m^2*atm$, preferably less than 50 $cm^3/(m^2*day*atm)$, when measured in accordance with ASTM D-3985. Common polymers for the heat-resistant outer layer are, for example, ethylene homo- or copolymers, in particular HDPE, ethylene copolymers and cyclic olefins, such as ethylene/norbornene copolymers, propylene homo- or copolymers, ionomers, polyesters, polyamides.

The film in its multilayer form may further comprise other layers such as adhesive layers, filling layers and the like to provide the thickness necessary for the film and improve its mechanical properties, such as puncture resistance, abuse resistance, formability and the like. The film is obtainable by any suitable co-extrusion process, through a flat or circular extrusion head, optionally by co-extrusion or by hot blow molding.

Again for use in a skin-pack or VSP packaging process, the film is substantially non-oriented. Typically, the film, or only one or more of its layers, is cross-linked to improve, for example, the strength of the film and/or heat resistance when the film is brought into contact with the heating plate during the vacuum skin packaging process. Crosslinking can be achieved by using chemical additives or by subjecting the film layers to an energy-radiation treatment, such as high-energy electron beam treatment, to induce crosslinking between molecules of the irradiated material. Films suitable for this application may have a thickness in the range between 50 μm and 500 μm, optionally between 60 μm and 3000 μm, even more optionally between 65 μm and 100 μm.

For use in packaging processes of products under controlled atmosphere (MAP) or in a natural atmosphere (unmodified atmosphere), the film applied to the substrate (plastic film, in particular polymeric) is typically mono-layer or multilayer, having at least one heat-sealable layer, optionally capable of thermo-retracting under heat action. The applied film may further comprise at least one gas barrier layer and optionally a heat-resistant outer layer. In particular, the film can be obtained by co-extrusion and lamination processes. The film may have a symmetrical or asymmetrical structure and may be single-layer or multilayer. Multilayer films are composed of at least two layers, more frequently at least five layers, often at least seven layers.

The total thickness of the film can range from 30 μm to 500 μm, optionally from 40 μm to 300 μm, even more optionally from 50 μm to 200 μm; in one embodiment the film, has a thickness of between 65 μm and 100 μm. The films may possibly be cross-linked. Crosslinking can be achieved by irradiation with high energy electrons at an appropriate dosage level as known in the art. The films described above can be heat-shrinkable or heat-curable. Heat-shrinkable films normally show a free shrinking value at 120° C. (value measured in accordance with ASTM D2732, in oil) in the range from 2% to 80%, normally from 5% to 60%, in particular from 10% to 40% in both longitudinal and transverse directions. Heat-curable films normally have a shrinkage value of less than 10% at 120° C., normally less than 5% both in the transverse and longitudinal direction (measured in accordance with the ASTM D2732 method, in oil). Films normally comprise at least one heat-sealable layer and an outer layer (the outermost) generally consisting of heat-resistant polymers or polyolefins. The welding layer typically comprises a heat-sealable polyolefin which in turn comprises a single polyolefin or a mixture of two or more polyolefins such as polyethylene or polypropylene or a mixture thereof. The welding layer may also be provided with anti-fogging properties through known techniques, for example by incorporation in its composition of anti-fogging additives or through a coating or a spraying of one or more anti-fogging additives that counteract the fogging on the surface of the welding layer. The welding layer may also comprise one or more plasticizers. The outermost layer may comprise polyesters, polyamides or polyolefins. In some structures, a mixture of polyamide and polyester can be used for the outermost layer. In some cases, the films include a gas barrier layer. Barrier films normally have an oxygen transmission rate, also called OTR (Oxygen Transmission Rate) below 200 $cm^3/(m^2*day*atm)$ and more frequently below 80 $cm^3/(m^2*day*atm)$ evaluated at 23° C. and 0% RH measured in accordance with the ASTM D-3985 method. The barrier layer is normally made of a thermoplastic resin selected from a saponified or hydrolyzed product of ethylene-vinyl acetate copolymer (EVOH), an amorphous polyamide and vinyl-vinylidene chloride and mixtures thereof. Some materials include an EVOH barrier layer, layered between two polyamide layers. In some packaging applications, films do not include any gas barrier layer. These films usually comprise one or more polyolefins as defined herein. Non-gas barrier films normally have an OTR (evaluated at 23° C. and 0% RH in accordance with ASTM D-3985) of 100 $cm^3/(m^2*day*atm)$ up to 10000 $cm^3/(m^2*day*atm)$, more often up to 6000 $cm^3/(m^2*day*atm)$.

Peculiar compositions based on polyester are those used for the films of the so-called ready-meals. For these films, the polyester resins of the film may constitute at least 50%, 60%, 70%, 80% and 90% by weight of the film. These films are normally used in combination with supports, especially trays, made from polyester. In the case of packages for fresh red meat, a double film may be used, comprising an oxygen permeable inner film and an oxygen impermeable outer film. The combination of these two films greatly prevents discoloration of the meat even in the most critical situation in the barrier packaging of fresh meat or when the packaged meat extends outside the cavity defined by the tray, or in which the product emerges from the upper peripheral edge of the lateral wall. These films are described for example in European patent applications EP1848635 and EP0690012.

The film may be single-layer. The typical composition of the single-layer films comprises the polyesters as defined herein and mixtures thereof or the polyolefins as defined herein and mixtures thereof. In all the film layers described herein, the polymeric components may contain suitable amounts of additives normally included in such compositions. Some of these additives are normally included in the outer layers or in one of the outer layers, while others are normally added to the inner layers. These additives include slipping or anti-blocking agents such as talc, waxes, silica and the like, or antioxidant agents, stabilizers, plasticizers, fillers, pigments and dyes, cross-linking inhibitors, cross-linking agents, UV absorbers, odor absorbers, oxygen absorbers, bactericides, antistatic agents, antifog agents or compositions and similar additives known to the man skilled in the art of packaging. The films may have one or more holes adapted to allow the fluid communication between the inner volume of the package and the external environment, or, in the case of a food product, allow the packaged food to exchange gas with the outside; the perforation of the films can, for example, be performed by means of a laser beam or mechanical means, such as rollers provided with needles. The number of perforations applied and the size of the holes influence the permeability to the gases of the film itself. Micro-perforated films are usually characterized by OTR values (evaluated at 23° C. and 0% RH in accordance with ASTM D-3985) of 2500 $cm^3/(m^2*day*atm)$ up to 1000000 $cm^3/(m^2*day*atm)$. Macro-perforated films are usually characterized by OTR values (evaluated at 23° C. and 0% RH in accordance with ASTM D-3985) higher than 1000000 $cm^3/(m^2*day*atm)$.

Material Specifications

The term paper material means paper or cardboard; in particular, the sheet material that can be used to make the support may have a weight of between 30 $g/m^2$ and 600 $g/m^2$, in particular between 40 $g/m^2$ and 500 $g/m^2$, even more particularly between 50 $g/m^2$ and 250 $g/m^2$.

PVDC is any vinylidene chloride copolymer in which a prevalent amount of the copolymer comprises vinylidene chloride and a lower amount of the copolymer comprises one or more unsaturated monomers copolymerizable therewith, typically vinyl chloride and alkyl acrylates or methacrylates (for example methyl acrylate or methacrylate) and mixtures thereof in different proportions.

The term EVOH includes saponified or hydrolyzed ethylene-vinyl acetate copolymers and refers to ethylene/vinyl alcohol copolymers having an ethylene co-monomer content preferably composed of a percentage of from about 28 mole % to about 48 mole %, more preferably from about 32 mole % and about 44 mole % of ethylene and even more preferably, and a saponification degree of at least 85%, preferably at least 90%.

The term polyamides is meant to indicate homo- and co- or ter-polymers. This term specifically includes aliphatic polyamides or co-polyamides, e.g. polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partly aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are, for example, terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanodimethanol and the like. Examples of useful polyesters include poly(ethylene terephthalate) and copolyesters obtained by reaction of one or more carboxylic acids with one or more dihydroxylic alcohols.

The term copolymer means a polymer derived from two or more types of monomers and includes terpolymers. Ethylene homo-polymers include high density polyethylene (HDPE) and low density polyethylene (LDPE). Ethylene copolymers include ethylene/alphaolefin copolymers and unsaturated ethylene/ester copolymers. The ethylene/alpha-olefin copolymers generally include copolymers of ethylene and one or more co-monomers selected from alpha-olefins having between 3 and 20 carbon atoms, such as 1-butene, 1-pentene, 1-hexene, 1-octene, 4-methyl-1-pentene and the like. Ethylene/alpha-olefin copolymers generally have a density in the range of from about 0.86 $g/cm^3$ to about 0.94 $g/cm^3$. It is generally understood that the term linear low density polyethylene (LLDPE) includes that group of ethylene/alpha-olefin copolymers which fall in the density range of between about 0.915 $g/cm^3$ and about 0.94 $g/cm^3$ and in particular between about 0.915 $g/cm^3$ and about 0.925 $g/cm^3$. Sometimes, linear polyethylene in the density range between about 0.926 $g/cm^3$ and about 0.94 $g/cm^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers can be obtained with heterogeneous or homogeneous polymerization processes. Another useful ethylene copolymer is an unsaturated ethylene/ester copolymer, which is the ethylene copolymer and one or more unsaturated ester monomers. Useful unsaturated esters include vinyl esters of aliphatic carboxylic acids, in which esters have between 4 and 12 carbon atoms, such as vinyl acetate, and alkyl esters of acrylic or methacrylic acid, in which esters have between 4 and 12 carbon atoms. Ionomers are copolymers of an ethylene and an unsaturated mono-carboxylic acid having the carboxylic acid neutralized by a metal ion, such as zinc or, preferably, sodium. Useful propylene copolymers include propylene/ethylene copolymers, which are copolymers of propylene and ethylene having a percentage by weight content mostly of propylene and propylene/ethylene/butene ter-polymers, which are copolymers of propylene, ethylene and 1-butene.

DETAILED DESCRIPTION

Package

Reference numeral 100 indicates as a whole a package configured for containing at least one product P, for example of a food type.

As can be seen for example in FIG. 1, the package 100 comprises at least one support 1 configured for receiving the product P and at least one closing film 10, for example of plastic material, sealingly bonded to the support 1: the film 10 is configured for defining—in cooperation with the support 1—a housing compartment 5 for the product P and for being subsequently removed, totally or partially, by a user during a step of opening the package 100 so as to allow the withdrawal of or the access to the product P.

In the attached figures, a support 1 having a polygonal shape, in particular rectangular, is illustrated. However, the possibility of providing a support 1 having a square, rhomboidal, triangular, elliptical, circular, semi-circular shape or a combination thereof is not excluded. The support 1 is formed from a continuous substrate, for example from a plastic foil material, and comprises at least one base 2 representing the part of the support 1 suitable for receiving the product P and directly supporting the same; the support 1 further comprises at least one peripheral flange 6 surrounding the base 2. The peripheral flange 6 further comprises an annular bonding area **6*a* adapted to engage the film 10 closing the package 100 and to define—in cooperation with the closing film 10—the fluid-tight housing compartment 5 containing the product P. The fluid-tight package 100 may be a vacuum package 100 (so-called "SKIN" type package) wherein the closing film 10 adheres as a skin to the product P and to at least a portion of surface 1*a* (upper surface) of the support not covered by the product: in this case therefore the annular bonding area 6 at the flange 6 is only part of the actual bonding area between covering film and support. Alternatively, the housing compartment 5 may host a predetermined gas or gas mixture to define a modified atmosphere package 100 (so-called "MAP" type package). The package may, in a further alternative, be sealed at atmospheric pressure, without a modified atmosphere within the housing compartment 5**.

The peripheral flange 6 radially extends all around the base 2 so as to define a closed external perimeter 3. In a condition of normal use of the package, where the package 100 rests on the base 2 of the support 1, the peripheral flange 6 preferably extends along a substantially horizontal plane.

In the case of a flat type support 1, the peripheral flange 6 and the base 2 lie essentially on the same plane (flat supports are not shown in the accompanying figures).

On the other hand, in the case of a support with a side wall (see the attached figures), the flange 6 is vertically spaced from the base 2 and in particular is arranged at a height different from the base 2 such that the support 1 can essentially define a tray with a cavity for hosting a product (trays are typically used when the product has a vertical extension); in this case, the flange 6 may extend along a plane spaced apart from the base, in particular parallel to the lying plane of the base 2. In greater detail, the tray shaped support 1 shown in the attached figures comprises a bottom wall 8 and a lateral wall 7 emerging from the bottom wall 8 transversely to the latter and defining, in cooperation with said bottom wall 8, the housing compartment 5 for the product P: the flange 6 emerges radially away from the top edge of the lateral wall 7. The lateral wall 7 may form with the base wall an angle comprised between 90° and 160°, in greater detail between 90° and 150°, in even greater detail between 100° and 130°. As it can be seen from the accompanying figures, the lateral wall 7 top edge delimits an upper opening of the support 1 (or upper opening of the tray) through which the product P may pass during the packaging process in order to be positioned in the housing compartment 5 before the support and thus the product are closed by the closing film 10. The top edge of the lateral wall 7 may have shape similar to the shape of an outer perimeter of the bottom wall 8. In fact, the accompanying figures show an embodiment of the support 1 in which the outer perimeter of the lateral wall 7 and the outer perimeter of the bottom wall 8 both have a rectangular shape.

The peripheral flange 6 radially extends away from the top edge of the lateral wall 7: the flange may extend radially for a distance between 1 mm and 50 mm, in particular between 2 mm and 30 mm.

Although from here on the description refers to the alternative shown in the drawings of a support in the form of a tray with a side wall, note that the connection of the closing film 10 to the peripheral flange 6 and the way the gripping tab 22 may be formed and coupled with the rest of the package apply also to the alternative of a flat support.

The closing film 10 is engaged in a fluid-tight manner to the annular bonding area 6*a* of the flange 6. In particular, the closing film 10 is engaged to the flange 6 so that the housing compartment 5 is tightly sealed from the outer environment. The annular bonding area 6*a* is a continuous band extending all around the base 2 and encircling the product in order to determine a gas tight sealing of this latter from the atmosphere outside the package: in particular the annular bonding area 6*a* radially extends away from the base 2 along a radial extension comprised between 1 mm and 50 mm, in particular between 2 mm and 30 mm.

The closing film 10 comprises first and second surfaces 10*a*, 10*b*, respectively defining in use an upper and a lower surface opposite to each other; on its turn the support 1 is formed from a continuous substrate, for example from a plastic foil, having a first and a second surface 1*a*, 1*b* opposite to each other: in practice, the first and second surfaces 1*a* and 1*b* respectively define an upper and a lower surface of the support 1, with the exclusion of the zone or zones of the flange where a gripping tab 22 is defined, as it will be described in detail herein below. The second surface 10*b* of the closing film 10 faces the support 1 with at least part of the second surface 10*b* of the closing film 10, in particular a peripheral band of the closing film second surface 10*b*, being bonded to the first surface 1*a* at the annular bonding area 6*a* of the flange. Consequently, the first surface 10*a* of the closing film 10 and the second surface 1*b* of the support are directed to the outside of the package 1 and define most of the external surface of the same package.

In accordance with one aspect, the second surface 1*b* of support 1 may present heat bonding properties to the closing film 10 significantly different from the heat bonding properties of the first surface 1*a* to the same closing film, in order for the closing film to gas tightly and firmly heat bond to the first surface 1*a*, while not heat bonding or weakly heat bonding to the second surface 1*b*. In particular the second surface 1*b* of the substrate forming the support 1 comprises an external layer which inhibits (or sensibly reduces) bonding to the closing film 10, so that the second surface 1*b* is substantially prevented from being heat sealed to the closing film 10. The second surface 1*b* may comprise a not heat bondable (in particular not heat-sealable) material as previously described in the definitions section, for example wax, plastic with high melting point thermoplastic resins, such as for example polyesters (particularly PET), polyamides or PP homopolymer or resins chemically incompatible with the sealing layer of the closing film. Moreover, the non-heat sealable material may comprise smooth or embossed paper, ink, paint, metals such as aluminum.

On the other hand, the first surface 1*a* of the support 1 presents bonding properties to the closing film 10 fart better than those of the second surface 1*b*, allowing and promoting heat bonding, in particular heat sealing, with the closing film 10.

In a accordance with a further aspect, the substrate forming the support is selected such that the first surface 1*a* of the support 1 heat bonds, and specifically heat seals, to the closing film 10 at a heat bonding temperature interval comprised between 140° C. and 240° C., in particular between 180° C. and 220° C., while second surface 1*b* of the support 1 does not heat bond, in particular does not heat seal, to the closing film at the same heat bonding temperature interval. In other words, bringing the closing film at a temperature within the mentioned temperature interval and pressing the closing film against the substrate forming the support 1, the first surface 1*a* heat bonds with the closing film 10 while the second surface 1*b* does not heat bond (or weakly bond with a bonding strength significantly smaller than that between the closing film and first surface 1*a*) to the closing film.

Figure 7:
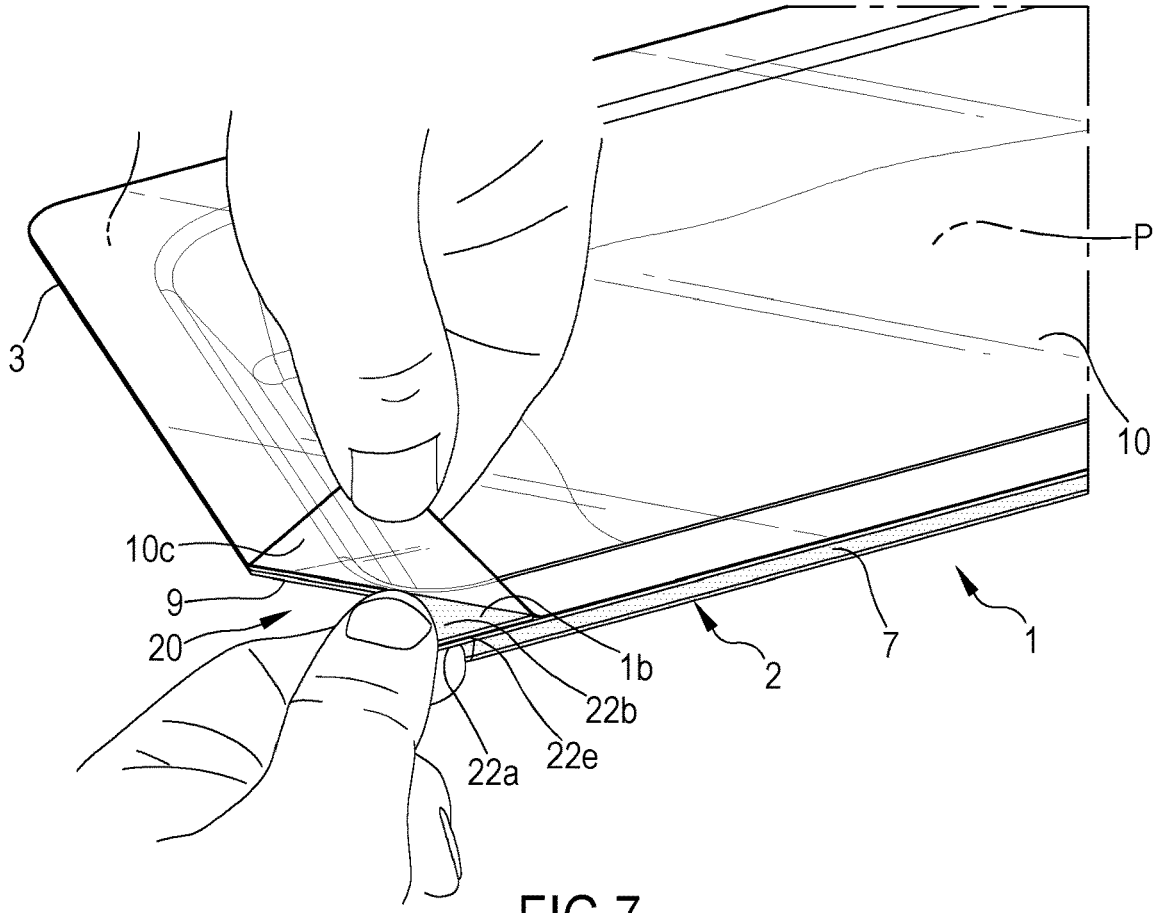
FIGS. 7 and 8 are a perspective views of a package according to the present invention during opening of the package.
Figure 13:
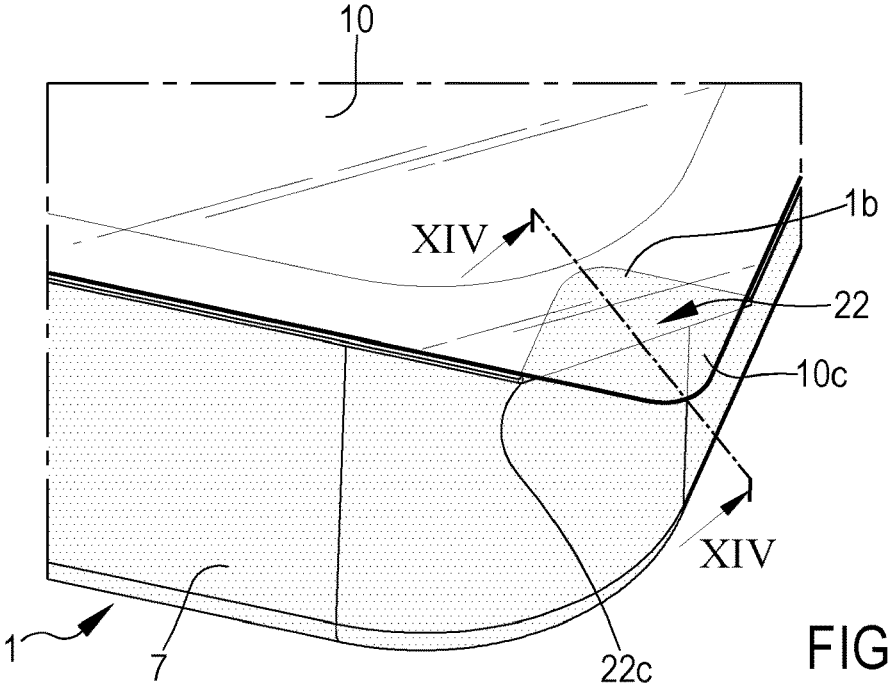
Figure 14:
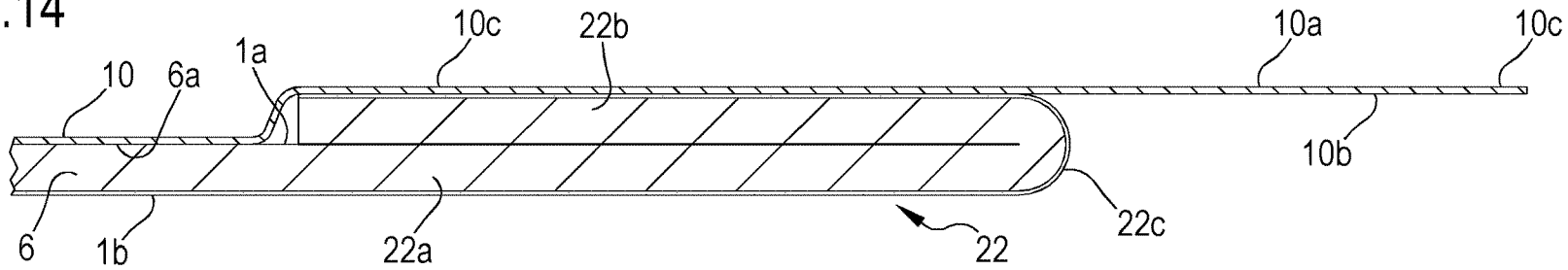

As shown in the figures, the package 100 is configured for defining a closing condition in which the closing film 10, in cooperation with the support 1, determines sealing of the housing compartment 5 and inhibits access to the latter (see for example FIGS. 1, 7 and 13). At least in the package closed condition, the closing film 10 further forms a flap 10*c* configured to be grabbed by a user to bring the package from the package closed condition to an open condition (see FIG. 8) where the closing film 10 is at least partially separated from the support 1 to allow access to the housing compartment 5. The flap 10*c*, when the package is in the closed condition, is substantially parallel to the peripheral flange 6 and radially extends outside the annular bonding area 6*a*, so that the portion of closing film coupled (i.e. heat bonded) to the annular bonding area is interposed between the housing compartment 5 and the flap 10*c*. The flap 10*c* is integral with the rest of the film 10, de facto forming a single sheet body. The flap 10*c* is preferably arranged at a corner portion of the closing film 10 and may present a substantially triangular shape. Moreover, the flap 10*c* is not bonded to the peripheral flange 6, so that a user is allowed to raise the flap from the flange, grab it and to tear off the closing film from the annular bonding area. According to the embodiments shown in the attached figures, the closing film 10 presents a rectangular shape: anyhow, different shapes such as any polygonal shape, in particular a squared shape, or a circular or semi-circular shape may also be provided.

The peripheral flange 6 further forms a gripping tab 22. For example, the gripping tab 22 may be an edge portion of the peripheral flange 6 and thus extend according to a direction away from the base 2. Depending upon the design choice, the gripping tab 22 may have polygonal shape such as triangular, rectangular, trapezoidal shape or a combination thereof. Of course other shapes are not excluded.

Figure 8:
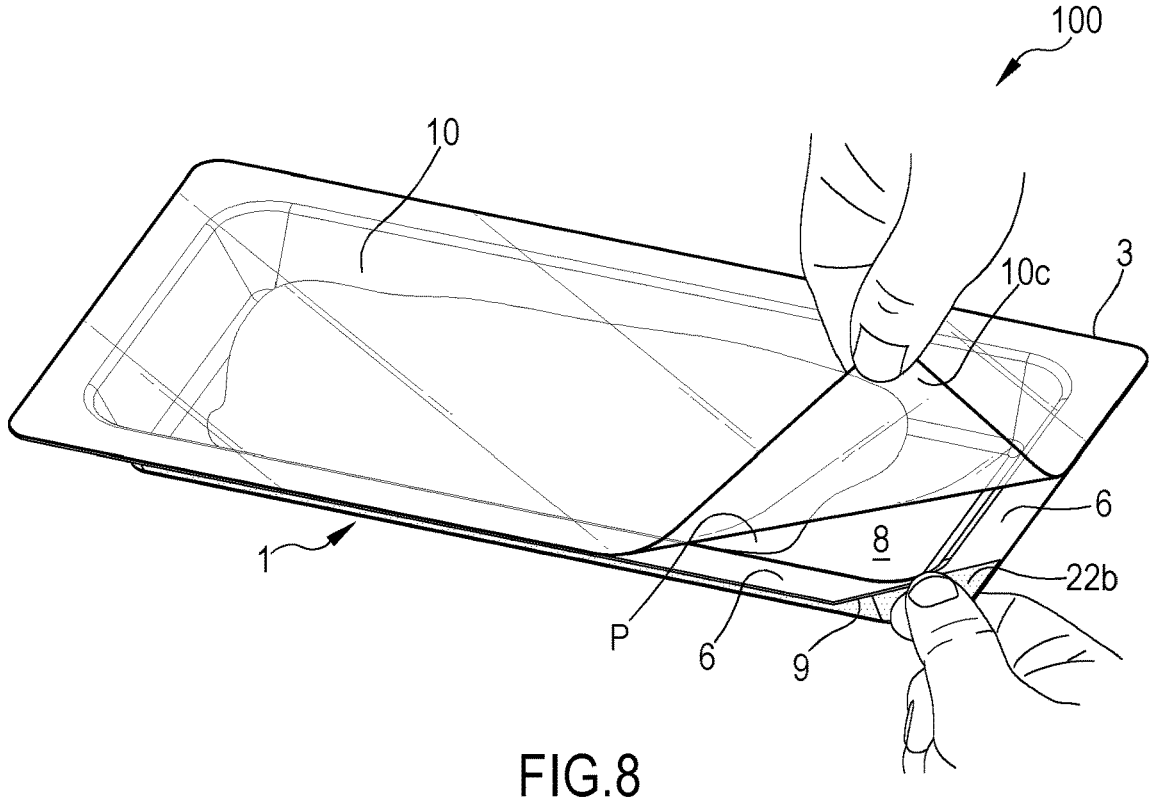

The gripping tab 22, as shown in FIGS. 7 and 8, is configured to be operated by a user during a step of opening the package 100: the user may grab both the gripping tab 22 and, i.e. with the other hand, the closing film to remove the latter from the support 1 and have access to the housing compartment 5. When the support has a peripheral flange 6 with polygonal perimeter 3, the gripping tab 22 is preferably arranged at a corner of the flange.

Figure 3:
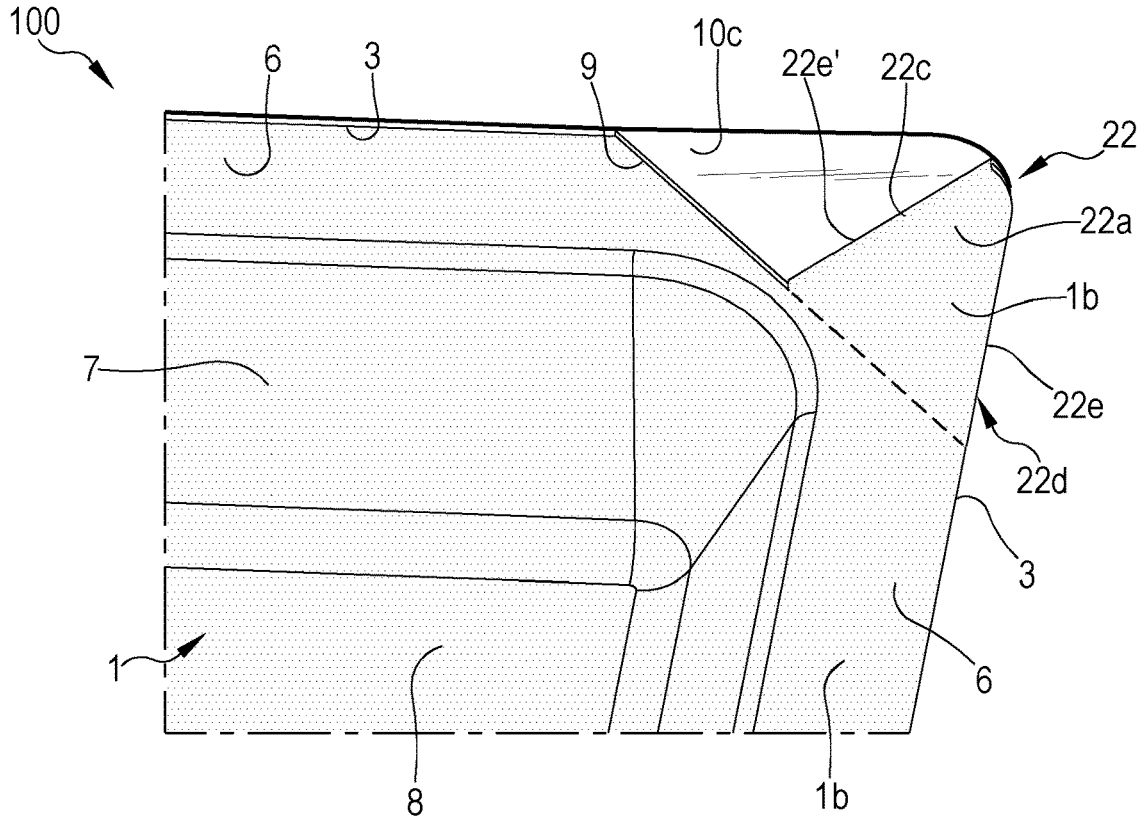
Figure 5:
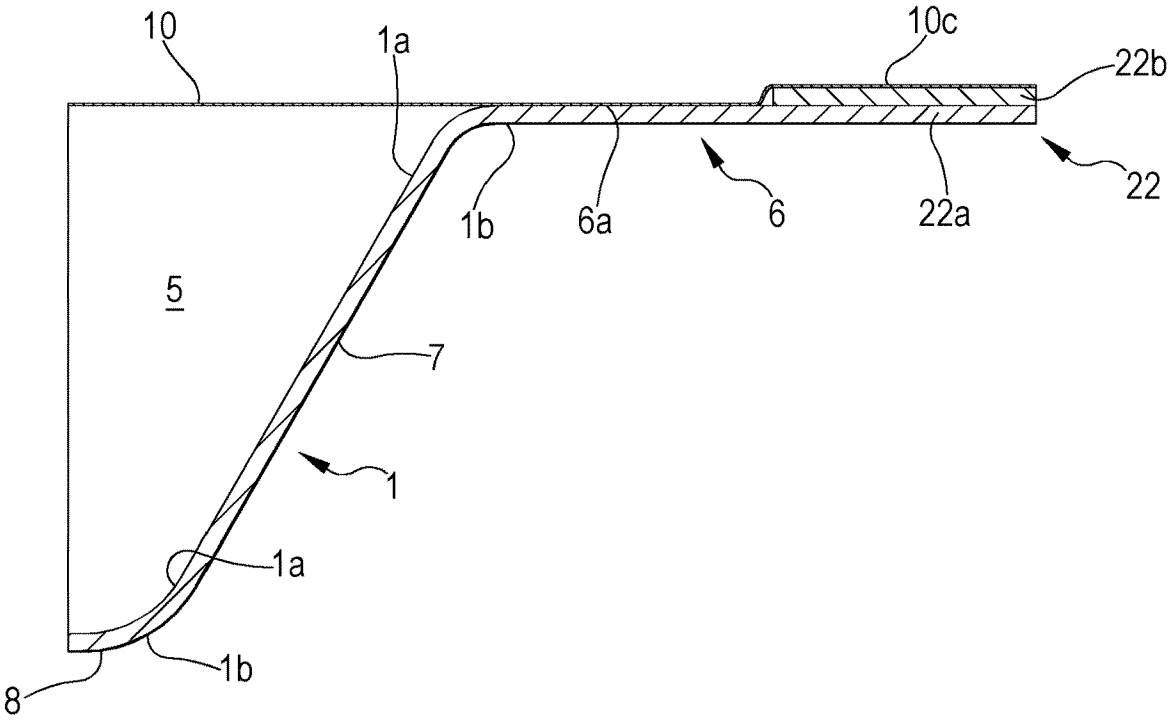
FIGS. 5 and 6 are section views of portion of a package including a gripping tab according to the present invention.
Figure 6:
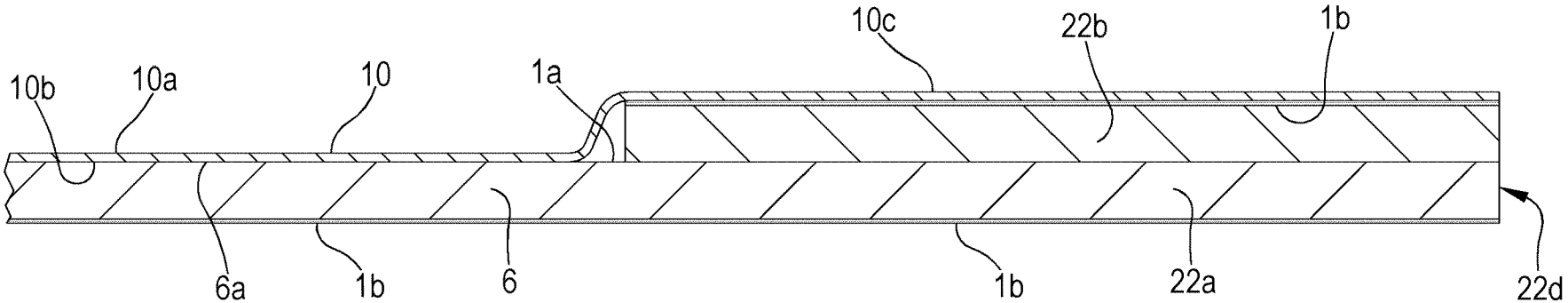

The gripping tab 22 comprises a first portion 22*a* integrally connected to the peripheral flange 6 and coplanar to the latter (see FIG. 3, showing the package from the bottom, and the section views of FIGS. 5 and 6). The first portion 22*a* comprises an inner side defined by a respective part of the first surface 1*a* and an external side, opposite to the inner side, defined by a respective part of the second surface 1*b*: the part of first surface 1*a* at the first portion 22*a* of the gripping tab 22 is coplanar to the part of first surface 1*a* of the rest of peripheral flange 6, while the part of second surface 1*b* extending at the first portion 22*a* of the gripping tab 22 is coplanar to the second surface 1*b* of the rest of the peripheral flange 6 (see FIG. 5). In particular, the inner side of the first portion 22*a* of the gripping tab 22 is entirely formed by said part of the first surface 1*a*, while the external side of the first portion 22*a* of the gripping tab 22 is entirely defined by said part of the second surface 1*b*. The gripping tab 22 also comprises a second portion 22*b* obtained, as it will be discussed further herein below, from a portion of the same substrate forming the rest of the support 1 and specifically from a portion of the flange 6 which is turned on the first portion 22*a* (for example by folding the second portion 22*b* above the and in superimposition of the first portion) such that the second portion 22*b* is arranged exactly above to the same first portion 22*a*: the first and the second portions 22*a* and 22*b* are preferably connected to each other. The second portion 22*b* comprises an inner side defined by a respective part of the first surface 1*a* and an external side, opposite to the inner side, defined by a respective part of the second surface 1*b*. In particular, the inner side of the second portion 22*b* of the gripping tab 22 is entirely defined by the respective part of the first surface 1*a*, while the external side is entirely defined by the respective part of the second surface 1*b*. The gripping tab 22 presents the inner side of the first portion 22*a* directly facing and in contact to the inner side of the second portion 22*b*, such that parts of the first surface 1*a* (one belonging to the first portion 22*a* and one belonging to the second portion 22*b*) come into direct contact as shown in FIG. 6: in particular the inner side of the first portion 22*a* is parallel to the inner side of the second portion 22*b*. By virtue of the above described design of the gripping tab 22, the external sides of the gripping tab 22 are entirely defined by parts of the second surface 1*b*. In the preferred variant herein disclosed the external sides of the gripping tab are portions of second surface 1*b*, which is characterized by being non-heat bondable to the closing film 10: in this way the closing film, and in particular the flap 10*c*, cannot be heat bonded to the gripping tab 22 because of the presence of the non-heat-bondable material on the external side (i.e. on the top side with reference to a use condition) of the gripping tab 22.

The second portion 22*b* of the gripping tab 22 is preferably arranged above the first portion 22*a* by folding the second portion 22*b* around a folding line 22*c*: in this way, the folding step allows to obtain a gripping tab which is externally presenting the second surface 1*b* and which remains physically connected to the first portion at the folding line. Furthermore, as shown in the FIG. 9, the first and the second portions 22*a*, 22*b* may present identical shape.

The first portion 22*a* may be heat-bonded (or connected in any other suitable manner) to the second portion 22*b* of the gripping tab 22 at the respective inner sides, which are defined by respective directly facing parts of first surfaces 1*a* preferably in heat bondable material.

The gripping tab 22, according to an aspect of the invention, comprises a peripheral edge 22*d* which is part of the radially external perimeter 3 of the peripheral flange 6. This allows to maximize the size of the gripping tab without impairing on the size of the annular bonding area 6*a*. In particular the peripheral edge 22*d* of the gripping tab is formed by overlapping peripheral edges of the first portion and of the second portion 22*b*.

Figure 4:
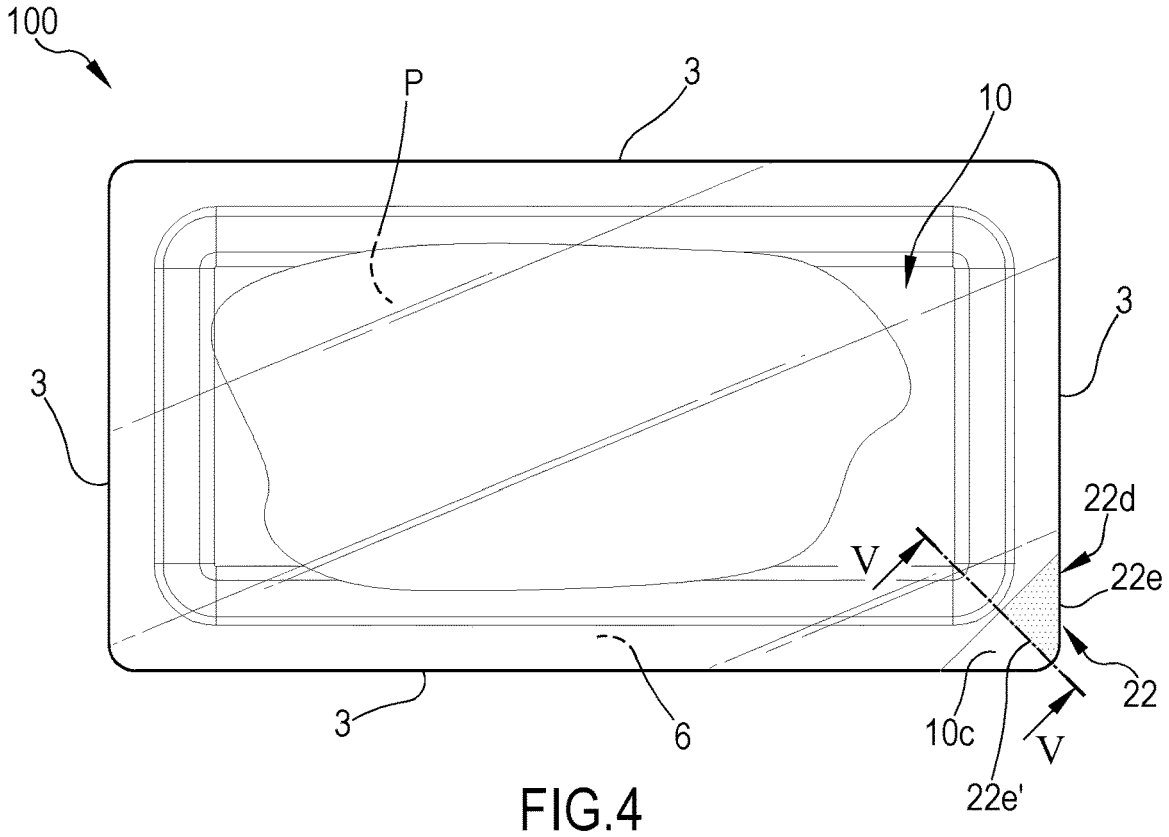
FIG. 4 is a top view of a package according to the present invention.

In the embodiment of FIGS. 1 to 10, which concerns a tray with a flange 6 of polygonal shaped perimeter 3, the peripheral edge 22*d* of the gripping tab 22 comprises a rectilinear side 22*e* extending as part of a rectilinear side of the external perimeter 3 of the peripheral flange 6. As shown in FIG. 4, a rectilinear side of the flange 6 thus includes the mentioned rectilinear side 22*e* of the peripheral edge 22*d* of the gripping tab 22. In other words, the rectilinear side 22*e* of the gripping tab 22 defines a part of the peripheral edge 22*d* of the gripping tab 22 and, at the same time, a rectilinear and terminal tract of one side of the external perimeter 3 of the peripheral flange 6; on the other hand, at the folding line 22*c*, a second rectilinear side 22*e*' of the peripheral edge 22*d* of the gripping tab 22 is formed which is directed radially (i.e., its prolongation intersects the annular bonding area 6*a*) and forms an acute angle (e.g. of 45°) with the direction of rectilinear side 22*e* of the gripping tab 22: as it is shown in FIG. 3 (which shows the support seen from the bottom) the folding line 22*c* (and thus the second rectilinear side 22*e*' of the peripheral edge of the gripping tab) and the rectilinear side 22*e* may converge and join in correspondence of a corner where the tab may take a rounded shape (of course depending upon the needs, the corner may be rounded or pointed or take any other desired shape).

Alternatively, in the embodiment of FIGS. 11 to 15, the folding line 22*c* is not directed radially (i.e. its prolongation would not intersect the annular bonding area 6*a*) but has the shape of a, preferably straight, line which is part of the perimeter 3. In particular, in the case shown of a support having a flange with a polygonal perimeter 3, the peripheral edge of the gripping tab, exactly at the folding line 22*c*, forms a rectilinear side which joins the terminal ends of two consecutive side edges of the flange 6. In practice, in accordance with this alternative, the rectilinear side at the folding line 22*c* is the only part of the peripheral edge of the gripping tab 22 in common with the perimeter 3. In fact, as the second portion 22*b* is folded above the first portion 22*a* along the folding line 22*c*, the rest of the peripheral edge of the gripping portion extends inside the area of the flange 6.

From a structural point of view, the gripping tab 22 includes the above mentioned folding line 22*c* which thus integrally connects the first portion 22*a* to the second portion 22*b*, such that the second portion 22*b* is folded above the first portion 22*a* around the folding line 22*c* which remains a line of connection between the first and second portions. Alternatively, the second portion 22*b* may be folded and a strip of material at folding line 22*c* be removed such that the first and second portions remain connected only by virtue of any bonding between their mutually facing surfaces. In yet a further alternative the second portion 22*b* may be cutout from the flange 6 and positioned as above described onto the first portion 22*a*, again with the connection between the first and second portions being obtained by virtue of any bonding between their mutually facing surfaces. In any case, the gripping tab 22 is an integral part of the peripheral flange 6 of the support 1 and, when present, the folding line 22*c* defines part of the external perimeter 3 of the peripheral flange 6. Again from a structural point of view, the first and the second portions of the gripping tab 22 are made of the same material of the support 1, and in particular are obtained from the flange 6. In more detail, according to a preferred embodiment, the bottom wall 8, the lateral wall 7 and the flange 6 may be made in one single piece by means of plastic deformation, in particular by thermoforming, of the same substrate, which is for example in the form of a plastic web or foil. Thus, the base 2, the lateral wall 7, the peripheral flange 6 and the gripping tab 22 form a single solid body made of plastic material.

In first embodiment, shown in FIGS. 1 to 10, the folding line 22*c* is distinct from, and consecutive to, the rectilinear side 22*e* of the peripheral edge 22*d* of the gripping tab 22: in particular the rectilinear side 22*e* is part of the external perimeter 3 of the flange 6 and defines an acute angle with the folding line 22*c* at the tip of the corner portion of the support 1. The folding line 22*c* extends along a direction transversal to the housing compartment 5 and to the annular bonding area 6*a*: in particular the folding line 22*c* (and thus the side 22*e*') extends from radially outermost part of the peripheral edge 22*d* of the gripping tab 22 to the annular bonding area 6*a* of the peripheral flange 6.

Figure 9:
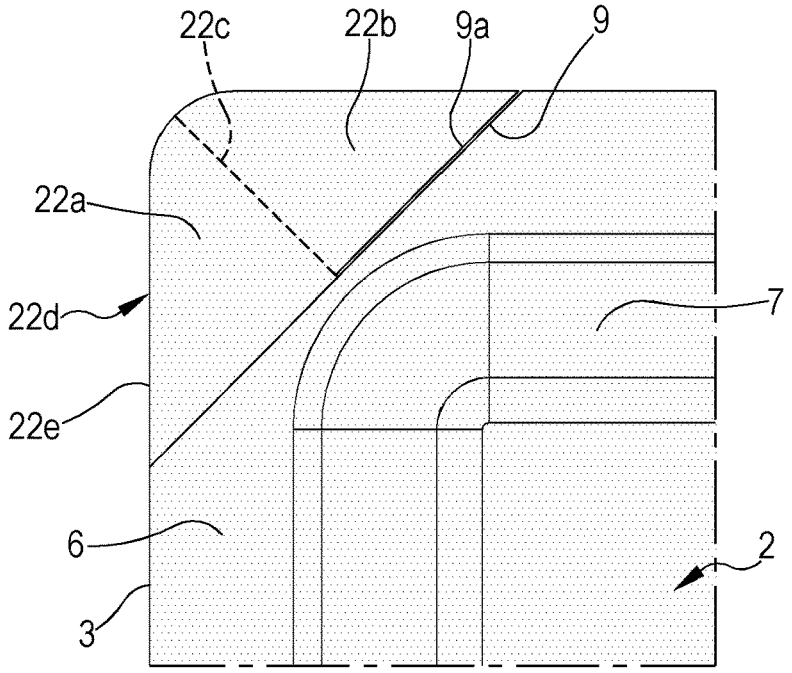
FIGS. 9 and 10 are views of an angular zone of support usable to make a package according to the present invention; in particular

According to the first embodiment, the second portion 22*b* is obtained by forming a separation or cutting line 9 on the peripheral flange 6: note separation line 9 may not necessarily be a true cutting line but simply an incision or a line where separation is facilitated e.g. by means of a sequence of points of separation or of thickness reductions or of incisions through the wall of the flange 6; the separation line 9 is transversal and extends up to the folding line 22*c*. FIG. 9 shows the first embodiment, before a folding step of the second portion 22*b* above the first portion 22*a*, wherein the separation line 9 is preferably perpendicular to the folding line 22*c*. The separation line 9 may be defined through a cutting tool, such as a blade or a punching tool. Alternatively, the separation line 9 may be initially formed through a weakened line which facilitates a subsequent separation. Once the separation line 9 has been formed, a separation edge 9*a* of the second portion 22*b* of the gripping tab is formed as well: in particular the separation edge 9*a* of the second portion 22*b* is consecutive to the folding line 22*c*. The gripping tab 22 is then completed by folding the second portion 22*b* around the folding line 22*c* onto the first portion 22*a* and by heat bonding the first and second portions together. In a possible alternative, the folding of the second portion 22*b* around the folding line 22*c* onto the first portion 22*a* may take place without then heat bonding the first and second portions together (thus the two portions remain in simple contact one folded over the other), or with the heat bonding of the first and second portions 22*a*, 22*b* taking place when the closing film is heat bonded to the support.

According to the first embodiment, the second portion 22*b* of the gripping tab 22 is delimited by the folding line 22*c*, the side 22*d* and the separation edge 9*a*, defining a triangular shape with, preferably, a square angle between the folding line 22*c* and the separation edge 9*a* or the separation line 9. In this case, therefore, the folding line 22*c* and the separation line 9 are part of the external perimeter of the peripheral flange 6.

Figure 2:
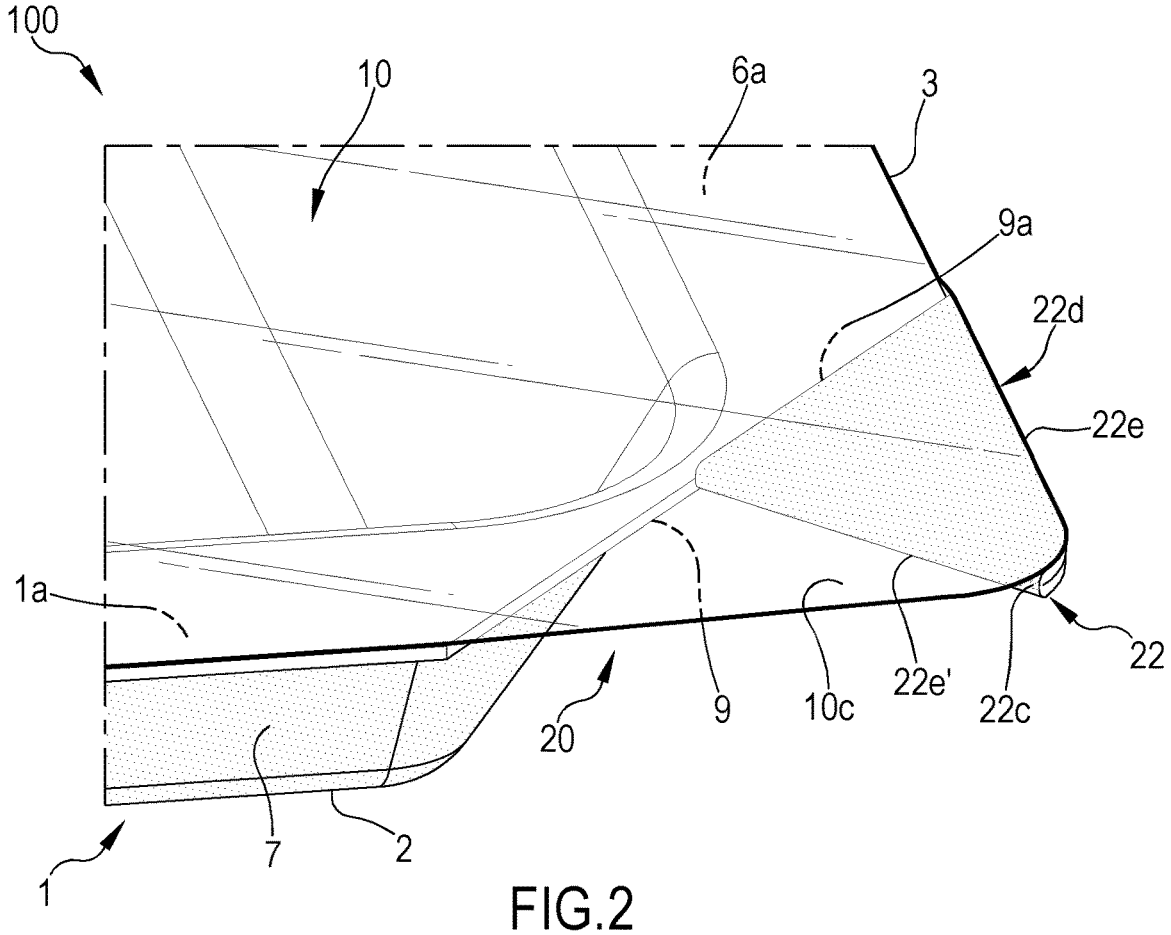
FIGS. 2 and 3 are detailed views of a part of package according to the present invention.
Figure 10:
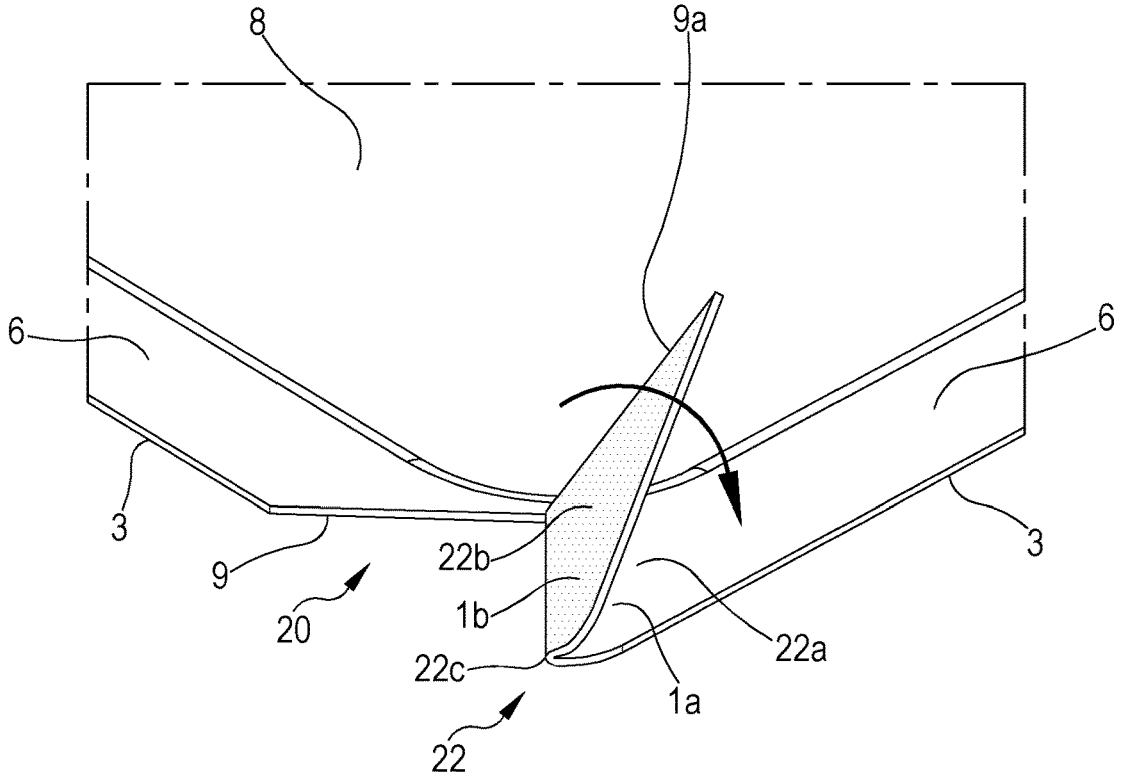
Figure 11:
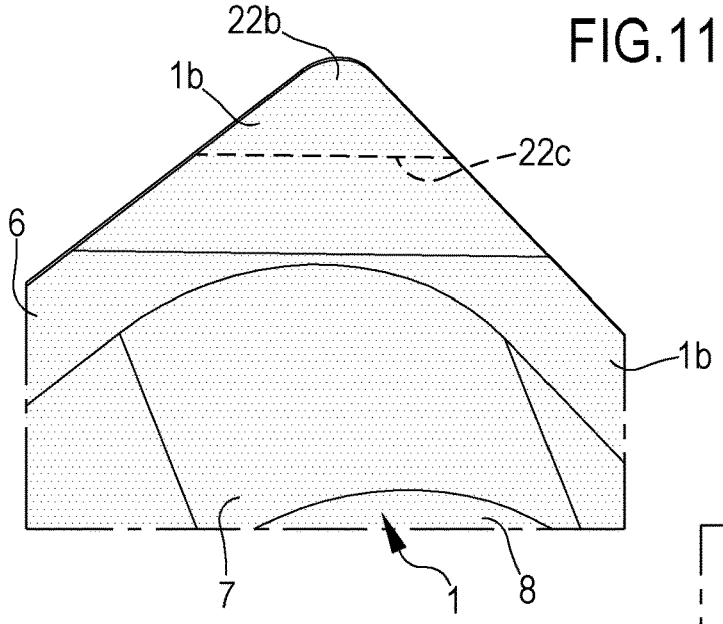
FIGS. 11 to 15 are detailed perspective views of a package according to an alternative embodiment of the present invention.

A cutout portion, adjacent to the gripping tab 22 and having the shape of the second portion 22*b*, is formed on the peripheral flange 6 by virtue of the above described process of formation of the gripping tab: the cutout portion defines an indent 20 in the external perimeter 3 of the peripheral flange 6. The indent 20, as shown in FIGS. 2 and 10, has the same shape of the gripping tab 22 and forms next to the gripping tab a profile of the external perimeter 3 which facilitates grabbing of the gripping tab by a user.

According to the first embodiment, the flap 10*c* of the closing film entirely covers the gripping tab 22: in particular the flap extends up to, and preferably not beyond, the side 22*d* of the gripping tab 22. In addition, the flap 10*c* extends to and beyond the folding line 22*c* covering the cutout portion of the peripheral flange 6, covering the indent 20. In other words the flap 10*c*, according to the first embodiment, covers both the whole (or at least a major portion) of the gripping tab 22 and the cutout portion and thus indent 20: therefore, a covering part of the flap 10*c* is arranged above the cutout portion/indent 20 and does not extend above any part of the peripheral flange 6, therefore resulting easily identifiable and easily graspable by a user. In other words, when opening the package, a user may easily grab the covering part of the flap 10*c*, which is not attached to an underling part of the flange 6: the presence and the specific position of the indent 20, therefore, facilitates opening of the package by a user. Again with reference to the configuration of the first embodiment, the closing film 10 thus covers the peripheral flange 6 at least in correspondence of the annular bonding area 6*a* and comprises a closing film perimeter counter shaped to the external perimeter of the peripheral flange 6, with the exception of the described part of the perimeter of the peripheral flange 3 at the cutout portion: indeed, in correspondence of the cutout portion, the peripheral flange 6 perimeter forms the indent 20 while the closing film 10 does not form any indent, extending above the cutout portion.

Figure 15:
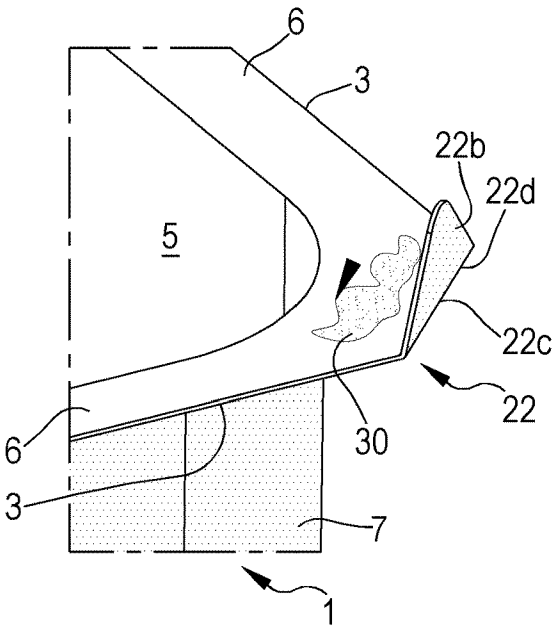

According to the second embodiment shown in FIGS. 11 to 15, the gripping tab 22 is obtained (as already mentioned) by folding a corner portion of the peripheral flange 6 above an inner portion of the flange: in this case the second portion 22*b* may have triangular shape or alternatively a trapezoidal shape. The gripping tab 22, according to this second embodiment, is externally delimited only by the folding line 22*c* which defines part of the external perimeter 3 of the peripheral flange 6. More in detail, the folding line 22*c* may join a first and a second side edges the flange 6 and, preferably, may form same angles with said first and second side edges of the flange. The first and the second portions 22*a*, 22*b* of the gripping tab may be bonded together by heat bonding or, as schematically shown in FIG. 15, by adding an amount of glue 30 in between, or by other techniques (it is not excluded that simply a mechanical connection is used between the two portions).

Figure 17:
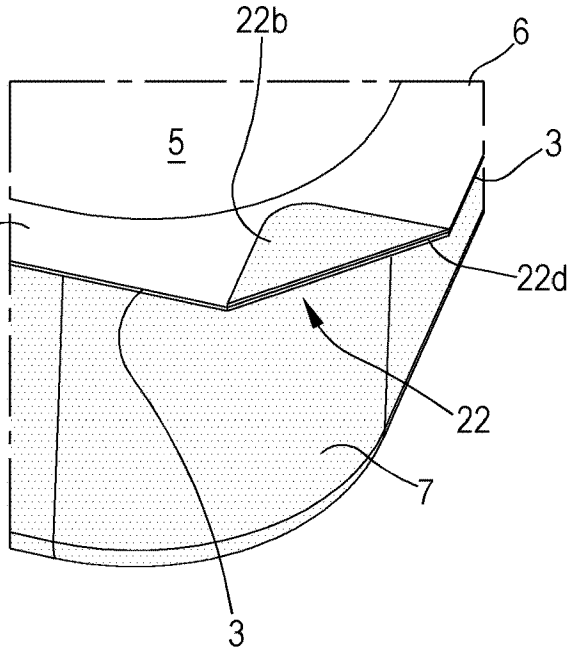
FIGS. 16 and 17 are detailed perspective views of a package according to a further embodiment of the present invention.
Figure 16:
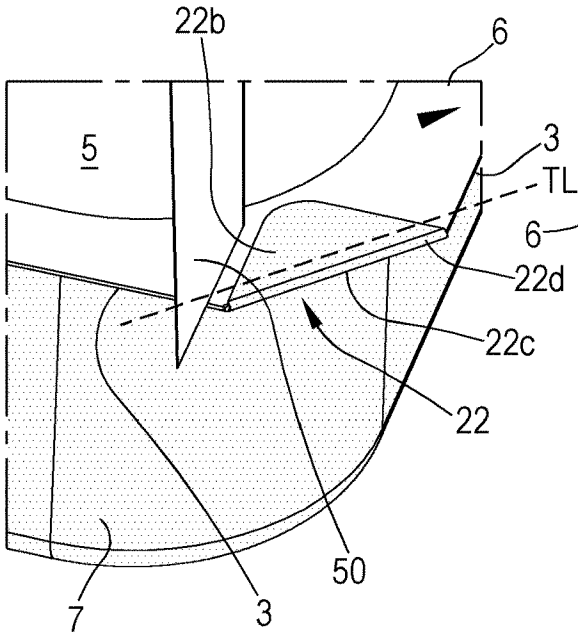

In a third embodiment, shown for example in FIG. 17, the gripping tab 22 may not comprise the folding line 22*c*. In particular, the folding line 22*c* described according to both the first and the second embodiments may be trimmed out along a trim line TL, as schematically shown in FIG. 16, e.g. by a blade or other tool. Therefore, in the third embodiment, the first portion 22*a* and the second portion 22*b* are integral each other but connected at the respective inner sides by, for example, a heat bonding procedure, in order to define a single body gripping tab. In such case, the trim line TL defines the side 22*d* of the gripping tab 22 as part of the external perimeter 3 of the peripheral flange 6.

The closing film 10, and in particular the flap 10*c*, is arranged above the gripping tab 22 and parallel to the latter at least when the package is in the closed condition; in the closed condition, the second surface 10*b* of flap 10*c* faces the external side of the second portion 22*b* of the gripping tab 22: in detail, the flap 10*c* may contact the external side of the second portion 22*b* of the gripping tab 22 but is not bonded to the external side of the second portion 22*b*, so that a user is allowed to raise the flap from the gripping tab and incline it relative to the surface of the peripheral flange 6.

The flap 10*c* preferably entirely covers the gripping tab without extending beyond the peripheral edge 22*d* of the gripping tab: in other words, in a preferred embodiment, the flap 10*c* extends up to the peripheral edge 22*d* of the gripping tab 22. Alternatively, the flap 10*c* may extend beyond the peripheral edge 22*d* of the gripping tab 22, emerging therefore with respect to the external perimeter 3 of the peripheral flange 6.

As it can be seen from the drawings the flap 10*c* is exclusively made from the top film and is optionally formed by a corner part of the top film. In practice, when the flap is operated (i.e., lifted relative to the flange) there is no part of the flange 6 and in any case no part of the support 1, which separates from the flange and remains attached to the flap 10*c*. This allows to have the gripping portion with a maximized area because no flange material becomes part of the flap when lifting the flap itself from the peripheral flange 6 to open the package 100.

Again referring to the drawings, it is possible to see how the gripping tab presents a size of each one of its top and bottom surfaces (i.e., the measure of the top surface area of the gripping tab and the measure of the bottom surface of the gripping tab 22) which is basically half or at least 40% of the surface area of the flap top ort bottom surfaces.

Process of Making Said Package 100

Another object of the present invention is a process for making the package 100, according to any one of the appended claims and/or according to the description given above.

The process described below may use the apparatus 300 described in the next section.

It should also be noted that, according to a further aspect of the invention, the various method steps described below can be carried out under the control of a control unit 311 (see FIG. 18) which acts on suitable actuators and/or motors and/or pumps and/or valves in order to carry out the various steps described and command movement of the various moving parts. The control unit may further be used to control appropriate vacuum source(s) or gas source(s) in order to control the suction and/or injection of gas into a packaging chamber used during formation of the package 100.

The process comprises a step of forming the support 1 from the substrate described above which may be in the form of a web or foil of plastic material having the first and second opposite surfaces 1*a*, 1*b* as described.

The step of forming the support 1 may further comprise a step of thermoforming the substrate at a thermoforming station 308 to define the bottom wall 8, the peripheral flange 6 and the lateral wall 7. In reality a number of supports are formed and advanced from the thermoforming station to the packaging station.

Figure 18:
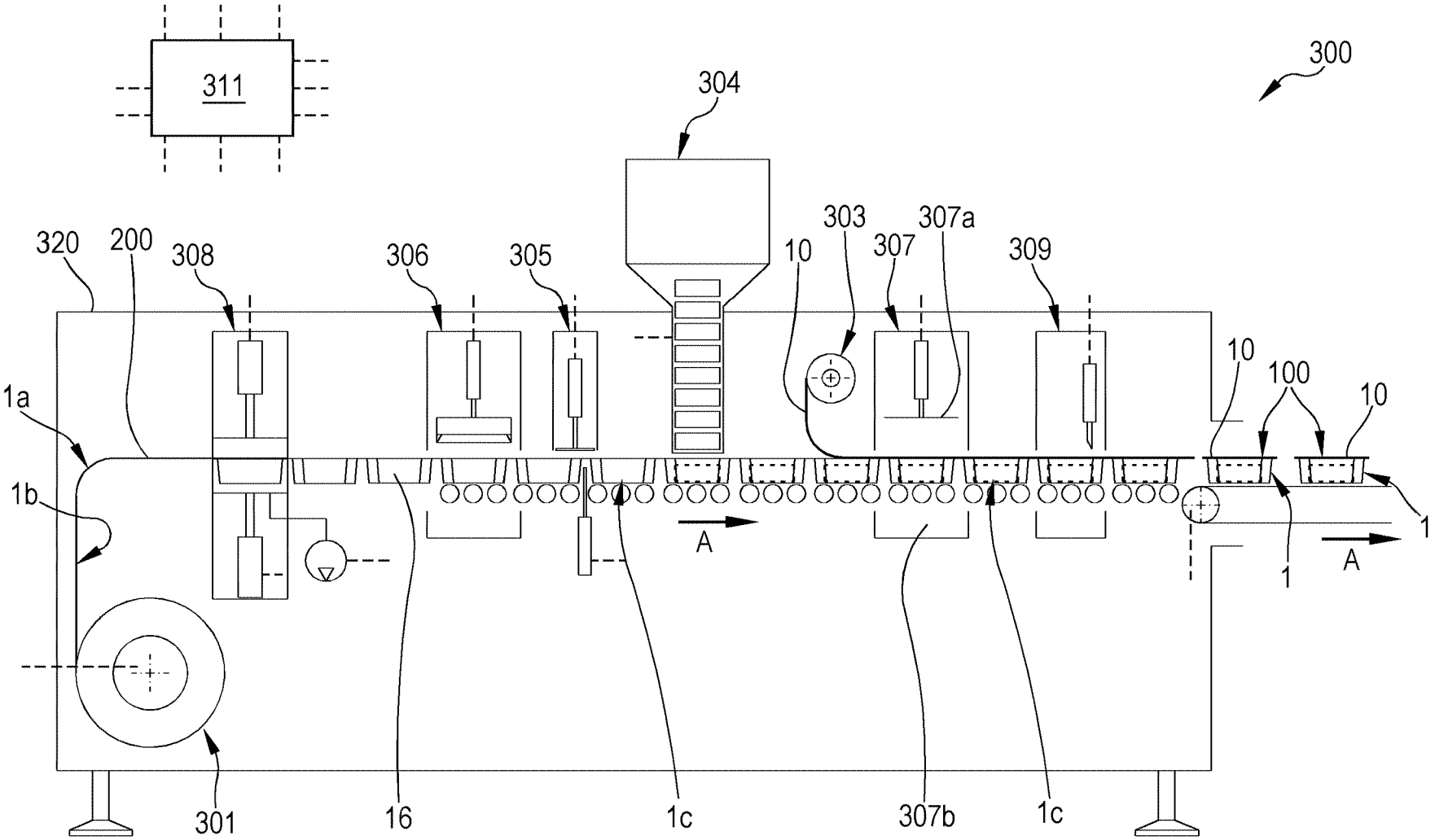
FIG. 18 is a schematic view of an apparatus for making packages according to the present invention.

As shown in FIG. 18, the process may comprise a step of moving the substrate along a predetermined advancement path A: as mentioned the substrate may be a continuous web 200 of plastic material unrolled from a reel 301.

Figure 19:
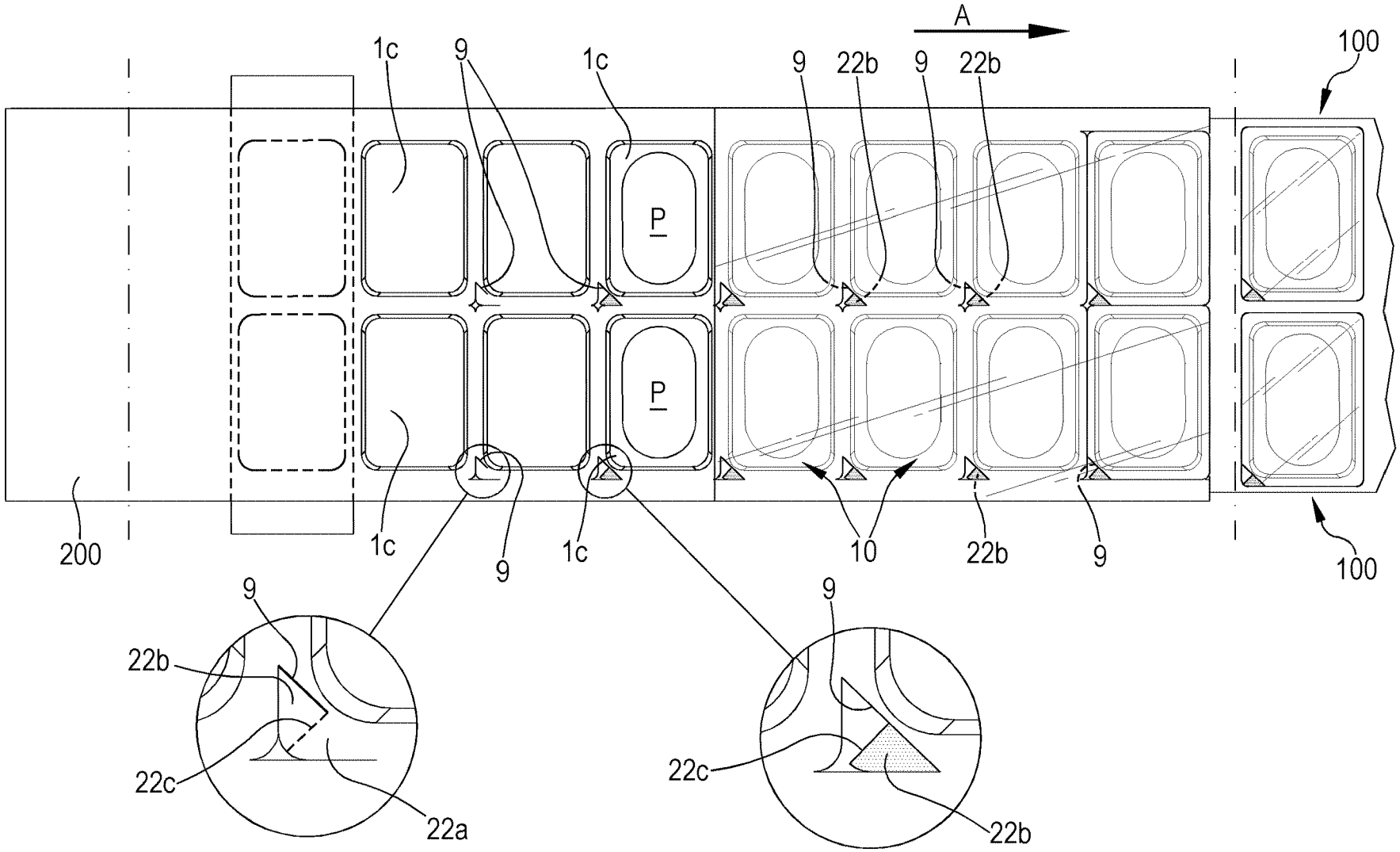
FIG. 19 is a top view of a continuous web from which supports according to the present invention are obtained.

The plastic continuous web 200 preferably has the first surface 1*a* which is heat sealable to the plastic material of the plastic film used to form the closing film 10 which will be applied to each of the supports 1; on the other hand the plastic continuous web 200 has the second surface 1*b*, which is not or very scarcely heat sealable to the plastic material of the plastic film used to form the closing film 10. The process contemplates thermoforming on the continuous web 200 a plurality of semi-finished supports 1*c* as shown in FIG. 19. Then, the process comprises subsequent cutting steps to define on the web 200 the external perimeter 3 of each support 1 and, according to the first embodiment, the respective separation line 9. The cutting step may be performed at a notching station 306 of the packaging apparatus, for example by means of a cutting tool or a punching tool.

Alternatively, a plurality of supports may be supplied in the form of discrete foils or discrete trays: in this case the external perimeter 3 of the supports may be already defined. Anyhow, the process may still comprise a cutting step for defining the separation line 9 on the support in order to form, according to the first embodiment, the second portion 22*b* of the gripping tab 22. Of course, if a tray of the type shown in FIGS. 11-15 is to be obtained, the separation line 9 is not formed.

Figure 12:
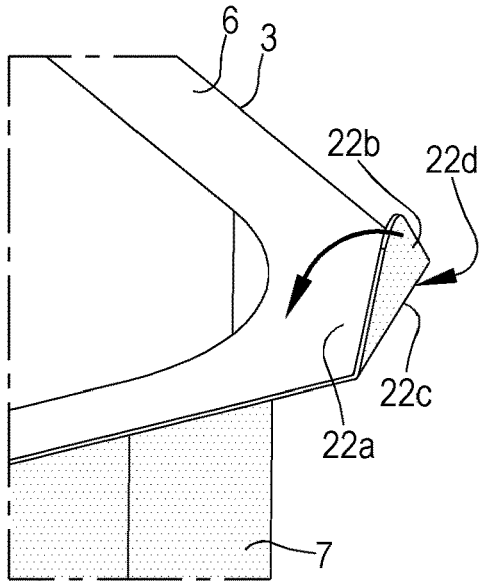

The process further comprises a step of forming the gripping tab 22 by folding the second portion 22*b* around the folding line 22*c* to bring the second portion 22*b* in overlapping position above the first portion 22*a*, as shown in FIGS. 10 and 12 respectively for the first and for the second embodiment. The step of forming the gripping tab 22 comprises a step of performing a thrust on the second surface 1*b* of the second portion 22*b* towards the first surface of the first portion 22*a*, until the inner side of the first portion 22*a* contacts the inner side of the second portion 22*b*. The process may also comprise a step of bonding the first portion 22*a* with the second portion 22*b* of the gripping tab 22: in particular this step comprises heat bonding the inner side of the first portion 22*a* with the inner side of the second portion 22*b* of the gripping tab 22. More in detail, the step of heat bonding comprises pressing the second portion 22*b* on the first portion 22*a* and providing a thermal source to allow welding of the inner sides. Alternatively, as shown in FIG. 15, an amount of glue may be added between the first and second portions 22*a*, 22*b*: although this alternative is shown in FIG. 15 according to the second embodiment, it may be applied also to process for making the package of the first embodiment of FIGS. 1-10.

The process further comprises a step of positioning at least one product P on the base 2 of the support 1. Once the product is positioned on the base 2, the process comprises a step of constraining the closing film 10 to the annular bonding area of the peripheral flange 6 forming the housing compartment 5. The step of constraining the closing film 10 to the support 1 comprises a step of fluid-tightly heat-sealing the film to the annular bonding area 6*a* of the support. The step of constraining the closing film 10 to the respective support or supports follows the step of forming the gripping tab 22 by folding the second portion 22 onto the first portion and, evidently, also follows the step of positioning the product on the support 1.

The process may also comprise a step of removing gas, in particular air, from the housing compartment 5 to define a vacuum skin package 100: this step of removing gas is antecedent to the step of constraining the closing film 10 to the annular bonding area 6*a* of the support.

Alternatively, the process may comprise a step of infusing a gas, in particular an inert gas, into the housing compartment 5 to define a controlled atmosphere package 100: the step of infusing gas is also antecedent to the step of constraining the closing film 10 to the annular bonding area 6*a*. In a variant, the process may comprise both the step of removing the gas from the housing compartment 5 and, subsequently, infusing a different gas into the housing compartment 5.

Apparatus for Making Said Package

An apparatus 300, schematically shown in FIG. 18, is configured to perform the process claimed and/or described above for making the package 100.

The apparatus 300 may comprise a number of operating stations arranged sequentially to define a production line, each of said operating stations BEING configured for performing a predetermined operation to obtain the package 100 at the output of the line. The various operating stations of the apparatus 300 are described below, following an order of sequence of the processing steps.

The apparatus 300 comprises at least one frame configured for supporting one or more operating stations and ensuring stability during the operating steps. The apparatus 300 further comprises a first supplying assembly 301 shown in FIG. 18, configured for providing the continuous web 200 and disposing it along the production line so that it extends smoothly through the plurality of operating stations. The first supplying group 301 provides the continuous web wound on a reel movable by rotation, in particular said reel can be: a) moved by an electric motor, b) braked, c) in free rotation.

The movement of the continuous web along a predetermined advancement path A is ensured by the presence of a conveyor 302, shown in FIG. 18, engaged to the frame. The conveyor 302 comprises a belt driven by one or more electric motors and configured for supporting the continuous web 200. Alternatively, the conveyor 302 may comprise a system for laterally hooking the continuous web 200 by means of clamps.

Downstream of the first supplying group 301 of the continuous web, the apparatus 300 may comprise at least one thermoforming station 308 configured for defining the semi-finished supports 1*c* on the continuous web 200: in particular the thermoforming station is provided to define a semi-finished support shaped as a tray comprising the bottom 8 and lateral 7 walls. The thermoforming station 308 provides for heating the plastic continuous web to a predefined temperature sufficient to deform the web and impose (e.g., by action of a mold) the desired shape to the support 1. In particular, the thermoforming station 308 may have an upper tool operative above the continuous web and a lower tool, with a concave mold, placed inferiorly with respect to the continuous web. The upper and lower tools of the thermoforming station 308 are movable with respect to each other and configured for being arranged at least in a spaced condition, at which the upper tool and the lower tool allow the introduction of the continuous web into the thermoforming station 308, and at least an approached or closed condition, at which the upper tool and the lower tool define a forming chamber. In the approached closed condition, the lower tool provides for the suction of gas present below the web to consequently allow the continuous web, adequately heated, to adhere to the walls of the mold present in the lower tool thus obtaining semi-finished support(s) of the desired shape. Downstream the thermoforming station 308, a plurality of thermoformed semi-finished supports 1*c* joined together are then defined on the continuous web 200. In the case of a flat support 1 (not shown in the accompanying figures), the packaging apparatus 300 may not include the thermoforming station 308. Also note that although, a thermoforming station using suction to form the continuous web against the mold is described, other types of molding systems are not excluded for example where the tools respectively carry a male and a female shape which when approached together form semi-finished support(s) of the desired shape, as it known to those skilled in the art.

In an additional alternative embodiment, a number of discrete pre-shaped tray supports 1 may be supplied: in this case, the packaging apparatus 300 does not include the thermoforming station 308.

Downstream of the supplying group 301, the apparatus 300 comprises a notching station 306, shown in FIGS. 18, configured for cutting or weakening the thermoformed continuous web to define at least part of the gripping tab 22. In particular the notching station 306 is configured to define the peripheral edges of the second portion 22*b* of the gripping tab and, optionally, the separation line 9.

The apparatus 300 further comprises a folding station 305 configured to implement the folding step of the second portion 22*b* on the first portion 22*a* of the gripping tab 22. The folding station 305 may comprises a lower pushing tool acting on the lower surface of the continuous web on the second portion 22*b*: an upper pushing tool may also be provided to complete the folding step. In addition, the lower and/or upper pushing tools may also include a thermal source and thus be configured under the control of the control unit to supply heat to the first and second portions 22*a*, 22*b* in order to determine mutual bonding (as explained above, in a variant the first and second portions 22*a* and 22*b* may however be simply folded the one above the other with no heat bonding).

Although the example of FIG. 18 shows a notching station 306 and a distinct folding station 305, it should be noted that the apparatus 300 may include a single station combining the functions of stations 305 and 306 and thus having at least one tooling configured to cut the continuous web in appropriate locations to form the second portion 22*b*, the same tooling being also configured to bend the second portion upwards relative to the rest of the flange 6 and then to further fold the same second portion in a way to bring it above and parallel to the first portion. The tooling may optionally be heated for heat bonding the second portion 22*b* to the first portion 22*a*. Note that in FIG. 18 it is shown that the separation of the supports from the continuous web 200 takes place after application of the closing film 10, i.e., after the packaging station described below. However, it is not excluded that finished supports are obtained already after the folding station 305.

The apparatus 300 further comprises a positioning station 304 configured to place a number of products P on appropriate areas of the semi-finished supports 1*c* or supports 1, in particular in correspondence of the bases 2. The positioning station 304 is configured for delivering the product P according to the position of the supports with respect to the positioning station. In particular, a position sensor may be provided in order to monitor the position of the supports on the conveyor 302 and to communicate a corresponding positioning signal to the control unit, which may then be configured to command delivery of the products by the positioning station based on the positioning signal.

Subsequent to (i.e. downstream in the attached FIG. 18) the positioning station 304 with respect to the advancement path A of the continuous web 200, the apparatus 300 comprises a second supplying assembly 303 (again refer to FIG. 18) configured for supplying the closing film 10 and for positioning it on the web 200. The second supplying assembly 303 unrolls the closing film 10 from a reel driven in rotation by an electric motor, or driven in rotation by the pulling action of the film 10 (note that absent a motor acting on the reel, this latter may be free to rotate or it may be controlled by a brake in order to keep the film under a certain tension). Downstream of the second supplying assembly 303 with respect to the advancement path A of the continuous web 200, the apparatus 300 comprises a packaging station 307 configured for receiving the web 200, on which one or more products P are placed, and at least a portion of said closing film 10, aligned above a given number of said support(s) 1 or semi-finished support(s) 1*c*. The packaging station 307 is configured for fluid-tightly engaging the closing film 10 to the continuous web 200; in particular, the packaging station fixes the closing film to the underlying support(s) or semi-finished support(s) at least at the annular bonding area of the flange 6 of each support 1 or semi-finished support 1*c*. In order to ensure fluid-tight engagement, the packaging station 307 comprises an upper tool 307*a* having a heater configured to heat at least the closing film 10 and a lower tool 307*b* configured for receiving one or more support(s) 1 or semi-finished supports (1*c*). The upper tool 307*a* is configured for heat-sealing the closing film 10 to the underlying semi-finished supports 1*c* or to the support(s) 1, so as to define the housing compartment 5 for the product P. In more detail, the upper and lower tool 307*a*, 307*b* are movable relative to one another between at least one spaced condition, at which the lower tool and the upper tool 307*a*, 307*b* allow the closing film 10 and of semi-finished support(s) or support(s) to properly position, and at least one approached or closed condition, at which the lower and upper tool 307*a*, 307*b* provide for heat sealing of the closing film at least at said annular bonding area 6*a* of each support or semi-finished support. In the approached or closed condition the upper and lower tools of the packaging station 307 may also define a chamber, for example a fluid tight chamber, in the case there is a need to form a package under vacuum and/or to create a controlled atmosphere in the package.

As described above, due to the presence of the not heat sealable material, the sealing occurs only between the closing film and the flange 6, without any (or with very limited) bonding between the closing film and the gripping tab 22.

The packaging station 307 may be provided with a suction system configured for removing air from the inside of the packaging station 307 so as to define a pressure lower than atmospheric pressure and facilitate formation of vacuum skin packages. In a further embodiment, the packaging station 307 is configured for removing air from the housing compartment 5 when the closing film 10 is fluid-tightly engaged to the continuous web 200. Optionally, the packaging station 307 may be provided with a blowing system configured for injecting gas into the packaging station 307 in order to obtain a modified atmosphere environment.

FIG. 18 schematically shows the plurality of semi-finished supports 1*c* closed by the closing film 10 coming out of the packaging station 307.

Downstream of the packaging station 307 with respect to the advancement path A of the web 200, the apparatus 300 comprises a separation station 309 configured for making a plurality of cuts through the web 200 and the closing film 10, so as to divide the semi-finished supports 1*c* and the respective portions of the closing film to obtain a plurality of packages 100. The cuts may be made using a punch having a cutting portion of predetermined shape. Alternatively, the through cuts are made by means of a cutting tool, a rotating blade or a high intensity concentrated beam of the laser type. The through cuts also define the rest of the external perimeter 3 of each support 1, as shown in FIG. 19, and, optionally, a peripheral edge of the first portion 22*a* of the gripping tab 22.

The invention claimed is:

1. A package comprising:

a support comprising:

a base configured to hold a product, and a peripheral flange surrounding the base and forming a gripping tab, wherein the support is formed from a substrate having a first surface and a second surface opposite to the first surface; and a film engaged with at least part of the peripheral flange, wherein the film and the support define a housing compartment for the product, wherein the film is configured to be partially separated from the support when the package is opened to allow access to the housing compartment;

wherein the gripping tab comprises:

a first portion of the support that includes a first part of the first surface and a first part of the second surface;

a second portion of the support that includes carrying a second part of the first surface and a second part of the second surface, wherein the second portion is in overlapping position above the first portion so that the first part of the first surface in the first portion faces the second part of the first surface in the second portion, and wherein the second part of the second surface of the first portion and the second part of the second surface of the second portion form opposite external sides of the gripping tab; and a peripheral edge that is part of a radially-external perimeter of the peripheral flange;

wherein, when the package is closed, the film forms a flap configured to be grabbed by a user to at least partially separate the film from the support to at least partially open the package and allow access to the housing compartment;

wherein, when the package is closed, the flap is parallel to the peripheral flange and the peripheral edge of the gripping tab is part of the radially external perimeter of the peripheral flange; and wherein the flap has a free portion that does not cover the gripping tab or the peripheral flange, wherein the flap extends above an indent in the perimeter of the peripheral flange.

2. The package of claim 1, wherein the flap is an integral part of the film and is made exclusively from a portion of the film.

3. The package of claim 1, wherein the flap does not include any part of the support.

4. The package of claim 1, wherein, before the package is open:

the film and the support prevent access to the housing compartment; and a flap of the film is at least partially raised from the gripping tab so that the gripping tab is operable by a user.

5. The package of claim 4, wherein, before the package is open, the flap is raised from the gripping tab, and wherein the raised flap is made exclusively from a portion of the film.

6. The package of claim 5, wherein the raised flap does not include any part or material of the support.

7. The package according to claim 1, wherein the free portion of the flap has the same shape of the gripping tab.

8. The package of claim 1, wherein the peripheral flange comprises a cutout portion adjacent to the gripping tab and has a shape of the second portion, wherein the cutout portion defines an indent in the external perimeter of the peripheral flange having the shape of the second portion.

9. The package of claim 1, wherein the peripheral flange comprises a cutout portion that is adjacent to the gripping tab and has a shape of the second portion.

10. The package of claim 1, wherein the external perimeter of the peripheral flange has a convex shape when viewed from above the package.

11. The package according to claim 8, wherein a portion of the external perimeter of the peripheral flange outside of the indent has a convex shape when viewed from above the package.

12. The package of claim 1, wherein the package is configured to be completely opened by a user completely removing the film from the support without removing any part of the support.

13. The package of claim 1, wherein the first and second surfaces are heat bonded to the film, and wherein heat bonding properties of the film to the second surface are different from heat bonding properties of the film to the first surface.

14. The package of claim 1, wherein the second portion is connected to the first portion.

15. The package of claim 1, wherein the peripheral edge of the gripping tab is formed by overlapping peripheral edges of the first portion and of the second portion.

16. The package of claim 1, wherein:

the package is closed with the film gas-tightly bonded to an annular bonding area of the peripheral flange to seal the housing compartment from an outer environment external to the housing compartment; and the annular bonding area is a part of the first surface and peripherally and entirely surrounds the housing compartment.

17. The package of claim 1, wherein the second portion is connected to the first portion at a folding line and the second portion is folded above the first portion around the folding line.

* * * * *